US006277498B1

(12) United States Patent
Endo et al.

(10) Patent No.: US 6,277,498 B1
(45) Date of Patent: Aug. 21, 2001

(54) INK JET RECORDING MATERIAL PROCESS FOR PRODUCING THE SAME AND INK JET RECORDING METHOD USING THE SAME

(75) Inventors: Eriko Endo, Urawa; Koiti Yasui, Tokyo; Hiroyuki Nemoto, Ichihara; Shunichiro Mukoyoshi, Ichikawa, all of (JP)

(73) Assignee: OJI Paper Co., Ltd., Tokyo (JP)

( * ) Notice: Subject to any disclaimer, the term of this patent is extended or adjusted under 35 U.S.C. 154(b) by 0 days.

(21) Appl. No.: 09/280,715

(22) Filed: Mar. 30, 1999

(30) Foreign Application Priority Data

| | | |
|---|---|---|
| Mar. 31, 1998 | (JP) | 10-085926 |
| Aug. 12, 1998 | (JP) | 10-228096 |
| Sep. 25, 1998 | (JP) | 10-271347 |

(51) Int. Cl.[7] ..... B41M 5/00

(52) U.S. Cl. ..... 428/500; 428/195; 428/211; 428/323; 428/341; 428/342; 428/532; 428/535

(58) Field of Search ..... 428/195, 532, 428/211, 323, 341, 342, 500, 535

(56) References Cited

U.S. PATENT DOCUMENTS

| | | | | |
|---|---|---|---|---|
| 5,686,602 | * | 11/1997 | Farooq et al. | 536/101 |
| 5,700,582 | | 12/1997 | Sargeant et al. | 420/476.6 |
| 5,707,722 | | 1/1998 | Iqbal et al. | 428/304.4 |

FOREIGN PATENT DOCUMENTS

| | | |
|---|---|---|
| 0 709 221 | 5/1996 | (EP) . |
| 0 763 433 | 3/1997 | (EP) . |
| 56-80489 | 7/1981 | (JP) . |
| 56-84992 | 7/1981 | (JP) . |
| 60-96067 | 5/1985 | (JP) . |
| 60-161188 | 8/1985 | (JP) . |
| 60-262685 | 12/1985 | (JP) . |
| 61-74879 | 4/1986 | (JP) . |
| 61-293886 | 12/1986 | (JP) . |
| 63-160875 | 7/1988 | (JP) . |
| 63-191670 | 8/1988 | (JP) . |
| 1-502805 | 9/1989 | (JP) . |
| 3-69380 | 3/1991 | (JP) . |
| 6-92012 | 4/1994 | (JP) . |
| 8-324103 | 12/1996 | (JP) . |

OTHER PUBLICATIONS

WO 98 32611, Jul. 30, 1998.

* cited by examiner

*Primary Examiner*—Bruce H. Hess
(74) *Attorney, Agent, or Firm*—Arent Fox Kintner Plotki & Kahn, PLLC

(57) ABSTRACT

An ink jet recording material having substantially no tackiness and capable of receiving thereon ink images having high resistance to cracking and blotting has an ink receiving layer formed on a support and including (A) hydroxypropylmethyl cellulose having a 2% aqueous solution viscosity of 200 cP at 20° C., and optionally (B) a N-vinyl pyrrolidon polymer and (C) a cationic resin.

10 Claims, No Drawings

INK JET RECORDING MATERIAL PROCESS FOR PRODUCING THE SAME AND INK JET RECORDING METHOD USING THE SAME

BACKGROUND OF THE INVENTION

1. Field of the Invention

The present invention relates to an ink jet recording material, a process for producing the same and an ink jet recording method using the same. More particularly, the present invention relates to an ink jet recording material having an ink receiving layer capable of recording thereon ink images with excellent gloss and clarity by any of pigment inks and dye inks, and free from generation of a tacky layer on the ink receiving layer surface, a process for producing the same and an ink jet recording method using the same.

2. Description of the Related Art

The ink jet recording system in which an aqueous ink is ejected through fine nozzles toward a recording material to form images on the recording material is advantageous in that the noise of the ink jet recording operation is low, colored images can be easily recorded, the recording can be effected at a high speed and the recording apparatus is cheaper than other printing apparatuses. Therefore, the ink jet recording system is widely utilized in terminal printers, facsimile machines and plotter machines and for printing account books and slips.

Hitherto, woodfree paper sheets improved in ink absorption and coated paper sheets having a surface coated with a porous pigments have been used as ink jet recording sheets. These conventional ink jet recording sheets have a low surface gloss and thus a mat-like appearance. However, with rapid popularization of the ink jet printer, and enhancement in quality and full coloration of the ink jet images, the ink jet recording material is required to have a high surface gloss, a high image quality, and a high color density of the images. For example, a gloss and image quality similar to those of silver salt photography are required. Also, since all of the above-mentioned conventional recording sheets are opaque and even when a support having a high surface gloss or a transparent support is employed, the coating layer formed on the support is opaque, a recording sheet having satisfactory gloss and transparency cannot be obtained. Accordingly, to provide an ink jet recording sheet having an enhanced transparency or gloss, an attempt has been made to form an ink receiving layer from a hydrophilic polymeric resin selected from, for example, starch, water-soluble cellulose derivatives, polyvinyl alcohol, and polyvinyl pyrrolidone, on a paper sheet or a plastic film. The cellulose derivatives include hydroxypropylmethylcellulose, methylcellulose, carboxymethylcellulose, hydroxypropylcellulose and hydroxyethylcellulose, as disclosed in Japanese Unexamined Patent Publication No. 56-080489, No. 63-160,875 and No. 3-69,388.

On other hand, in a conventional ink jet recording sheet having an ink receiving layer comprising, as a principal component, a porous pigment, to prevent the blotting of the ink in the boundaries between the images and to improve the water resistance of the printed dyes, it is generally known to add various cationic resins, for example, polyamines, polyethyleneimines, dicyandiamide condensation products, and quaternary ammonium salt compounds having a specific chemical structure to the ink receiving layer (coating layer), as shown, for example, by Japanese Unexamined Patent Publication No. 56-84,992, No. 60-161,188, No. 61-293,886 and No. 6-92,012.

As disclosed in Japanese Unexamined Patent Publication No. 63-160,875 and Japanese Unexamined Utility Model Publication No. 60-96,069, even in the ink receiving layer containing, as a principal component, cellulose derivatives, the water-resistance of the ink receiving layer can be enhanced by addition of the cationic resin. However, the increase in an amount of the cationic resin added to the ink receiving layer causes an increase in tackiness of the surface of the ink receiving layer and a decrease in drying rate of the ink printed on the receiving layer.

Japanese Unexamined Patent Publication No. 7-144,466 discloses an ink receiving layer formed from a coating liquid comprising, as a principal component, carboxymethylcellulose. However, the resultant ink receiving layer is unsatisfactory in the quality of images and water-resistance of the ink-receiving layer. Also, the coating liquid is poor in coating property and the resultant coating layer (ink receiving layer) is unsatisfactory in appearance.

Currently, the ink jet recording system is used as a large size graphic outlet apparatus, and the demand thereof in uses such as exterior and interior posters and signboards, and POP advertisements, is rapidly increasing.

In the conventional system, the coloring material comprising an aqueous dye ink having a high coloring property is usually employed. Also, an aqueous pigment ink having excellent light fastness has been developed and is now used in practice.

Japanese Unexamined Patent Publication No. 60-262,685, No. 63-191,670, No. 1-502,805 and No. 8-324,103 and Japanese PCT Publication No. 1-502,805 disclose ink jet recording materials having a ink-receiving layer comprising, as a principal component, a water soluble cellulose derivative, for example, hydroxyethylcelluloes, carboxymethylcellulose, hydroxypropylcellulose, etc. In these ink jet recording materials, since the ink receiving layer is transparent, the resultant ink images have excellent transparency and gloss. However, the drying rate of the ink on the receiving layer is low, and thus the printed surface of the ink receiving layer is kept in wetted and tacky condition for a long time and thus is difficult to handle. Also, when the printing is carried out by using an aqueous pigment ink, the ink receiving layer swells with the aqueous ink and thus the ink images printed on the ink receiving layer are cracked. The cracking refers to a phenomenon of cracking of the ink images comprising a coloring pigment, as a coloring material, when fixed on the ink receiving layer. The size of the cracks are relatively small but the cracks can be observed by the naked eye and cause the color density of the ink images to be uneven. This image cracking phenomenon is significantly found in color-mixed images which comprise two or more inks different in color from each other in a large amount. As a result, the cracks formed in the ink images cause the ink images to exhibit low color density and gloss, and thus to be unclear.

To solve the problem of the wetting and tacky condition of the printed ink images, Japanese Unexamined Patent Publication No. 61-74,879 discloses an ink receiving layer comprising an ethylene oxide polymer. In this type of the ink receiving layer, the wetted and tacky condition of the printed ink images can be solved. However, when the aqueous dye ink is used, this type of the ink receiving layer is disadvantageous in that the printed ink images exhibit a reduced gloss, the printed ink diffuses into the ink receiving layer with the lapse of time, and thus the resultant ink images are unsuitable for records which must be stored for a long period of time.

Also, this type of ink receiving layer exhibits a non-improved resistance to the image-cracking problem when the aqueous pigment ink is employed. Thus, on the pigment ink images formed on this type of ink receiving layer, cracking occurs.

To solve the cracking problem of the aqueous pigment ink images, Japanese Unexamined Patent Publication No. 10-67,168 provides an ink jet recording material having an ink receiving layer which comprises a binder and silica sol particles or alumina sol particles having an average particle size of 20 to 200 nm and exhibit a high transparency. In this type of ink jet recording material, since the ink is absorbed in fine pores formed between the fine pigment particles, there is a tendency that the swelling of the ink receiving layer by the ink is small, and the resistance of the aqueous pigment ink images printed on the ink-receiving layer to cracking is enhanced. However, the ink receiving layer per se has a tendency that during a drying procedure of the coating liquid layer for the ink receiving layer, the resultant ink receiving layer is cracked and exhibits a reduced transparency.

When the content of the binder is increased for the purpose of preventing the cracking of the ink receiving layer, the size of the pores formed between the pigment particles decreases. Therefore, to prevent the cracking of the ink receiving layer, the amount of the ink receiving layer should be increased. The increased amount of the ink receiving layer causes a reduced transparency of the resultant ink receiving layer. Also, a decrease in the ink-absorbing rate of the resultant ink receiving layer and an increase in the ease of the ink-diffusion into the ink receiving layer, occur, and it becomes difficult to balance the various properties of the ink receiving layer. Further, this type of ink receiving layer has an insufficient level of resistance to cracking of the aqueous pigment ink images formed thereon.

SUMMARY OF THE INVENTION

An object of the present invention is to provide an ink jet recording material having no tacky and wetted surface condition, capable of recording thereon ink images having a high gloss and an excellent clarity, and exhibiting excellent ink-drying property and superior water resistance, a process for producing the same and an ink jet recording method for the same.

Another object of the present invention is to provide an ink jet recording material provided with an ink receiving layer having a high transparency, an excellent resistance to cracking of printed aqueous pigment ink images, a high resistance to diffusion of the ink thereinto and an excellent ink drying property, and capable of recording thereon ink images having high uniformity, high color density and an excellent gloss, a process for producing the same and an ink jet recording method for the same.

Still another object of the present invention is to provide an ink jet recording material having excellent applicability of an aqueous dye ink thereto, similar to that of an aqueous pigment ink, a process for producing the same and an ink jet recording method for the same.

The above-mentioned objects can be attained by the ink jet recording material, the process for producing the same and the ink jet recording method for the same, of the present invention.

The ink jet recording material (1) of the present invention comprises a support and an ink receiving layer formed on a surface of the support and comprising hydroxypropylmethylcelullose (A) having a viscosity of 200 cP (centi Poise) or less, determined in a 2% aqueous solution thereof at a temperature of 20° C.

In the ink jet recording material (1) of the present invention the viscosity of the hydroxypropylmethylcellulose is preferably in the range of from 20 to 200 cP, determined in a 2% aqueous solution thereof at a temperature of 20° C.

In the ink jet recording material (1) of the present invention, the hydroxypropylmethylcellulose preferably has a degree of methoxy group-substitution which is defined as an average number of hydroxyl groups substituted by methoxy groups per cyclic unit group of cellulose, of 1.5 or more, In the ink jet recording material (1) of the present invention, the ink receiving layer optionally comprises, in addition to the hydroxypropylmethylcellulose (A), an N-vinyl pyrrolidone resin (B) comprising at least one member selected from the group consisting of homopolymers of N-vinyl pyrrolidone and copolymers of N-vinyl pyrrolidone with at least one other polymerizable monomer.

In the ink jet recording material (1) of the present invention the homopolymers of N-vinyl pyrrolidone and the copolymers of N-vinyl pyrrolidone with at least one other polymerizable monomer preferably have a weight average molecular weight of 5,000 to 100,000.

In the ink jet recording material (1) of the present invention, the N-vinyl pyrrolidone resin (B) is preferably present in an amount of 5 to 150 parts by weight per 100 parts by weight of the hydroxypropylmethyl-cellulose.

In the ink jet recording material (1) of the present invention the support preferably comprises a member selected from laminated paper sheets in which a base paper sheet is coated with a thermoplastic resin composition, and plastic films.

In the ink jet recording material (1) of the present invention, the ink receiving layer optionally comprises, in addition to the hydroxypropylmethylcellulose (A), an N-vinyl pyrrolidone resin (B) comprising at least one member selected from the group consisting of homopolymers of N-vinyl pyrrolidone and copolymers of N-vinyl pyrrolidone with at least one other polymerizable monomer, and at least one cationic resin(C) in a mixing ratio (A):(B):(C) in weight of the hydroxypropylmethycellulose(A) to the N-vinyl pyrrolidone resin(B) and the cationic resin(C), of 100:5 to 100:1 to 20.

In the ink jet recording material (1) of the present invention, the homopolymers of N-vinyl pyrrolidone and copolymers of N-vinyl pyrrolidone with at least one other polymerizable monomer preferably have a weight average molecular weight of 5,000 to 500,000.

In the ink jet recording material (1) of the present invention, preferably the support comprises a polyolefin resin-laminated paper sheet having a center line mean roughness Ra of 0.5 $\mu$m or less; and the ink receiving layer comprises at least the hydroxy-propylmethylcellulose (A) and pigment particles having an average particle size of 1 to 30 $\mu$m, the pigment particles having the average particle size of 1 to 30 $\mu$m being present in a content of 1 to 10 parts by weight per 100 parts by weight of the total weight of the ink receiving layer;

the ink receiving layer being present in a dry weight of 3 to 20 g/m$^2$, and the ink jet recording material having an ink jet recording surface exhibiting a mirror surface gloss at an angle of 75 degrees of 20 to 60%, determined in accordance with JIS P 8142.

In the above-mentioned ink jet recording material (1) of the present invention, preferably the pigment particles having the average particle size of 1 to 30 μm are selected from inorganic pigment particles having an average particle size of 3 to 15 μm.

The ink jet recording material (2) of the present invention comprises a support and an ink receiving layer formed on a surface of the support and comprising hydroxypropylmethylcellulose (a) and an N-vinylpyrrolidone resin (B) comprising at least one member selected from the group consisting of homopolymers of N-vinylpyrrolidone and copolymers of N-vinyl pyrrolidone with at least one other polymerizable monomer.

In the ink jet recording material (2) of the present invention, the ink receiving layer formed on the support comprises hydroxypropylmethylcellulose; (a) (B) a N-vinylpyrrolidone resin comprising at least one member selected from the group consisting of homopolymers of N-vinyl pyrrolidone and copolymers of N-vinyl pyrrolidone with at least one other polymerizable monomer; and (C) a cationic resin, the hydroxypropylmethylcellulose (a), the N-vinyl pyrrolidone resin (B) and the cationic resin are mixed in a mixing weight ratio (a)/(B)/(C) of 100:5 to 100:1 to 20.

The process of the present invention for producing the ink jet recording material comprises:

preparing an aqueous coating liquid which comprises hydrocypropylmethylcellulose(A) having a viscosity of 200 cP or less, determined in a 2% aqueous solution thereof at a temperature of 20° C.; adjusting the viscosity of the aqueous coating liquid to 500 to 15,000 cP, determined at a temperature of 25° C.; and coating a surface of a support with the aqueous coating liquid by using a die coater, to form an ink receiving layer.

The ink jet recording method of the present invention for the ink jet recording material comprises jetting imagewise liquid ink droplets containing, as a coloring material, a coloring pigment, toward the ink receiving layer of the ink jet recording material, to form ink images on the ink receiving layer.

DESCRIPTION OF THE PREFERRED EMBODIMENTS

The ink jet recording material of the present invention comprises a support preferably in a sheet form, and an ink receiving layer formed on a surface of the support and comprising an ink-absorbing polymeric material. The ink-absorbing polymeric material includes cellulose derivatives, for example, methylcellulose, hydroxypropylcellulose and hydroxypropylmethylcellulose which have methoxy and/or hydroxypropyl group, and can impart a high gloss and a satisfactory ink-absorption to the ink receiving layer. In the present invention, a specific hydroxypropylmethylcellulose, of which a 2% aqueous solution exhibits a viscosity of 200 cP or less at a temperature of 20° C., is employed.

As a result of a study of the inventors of the present invention concerning an ink jet recording material having an ink receiving layer comprising, as a principal component, a water-soluble resin, for example, a cellulose derivative, it has been found that when hydroxypropylmethylcellulose having a specific viscosity is employed, the resultant ink receiving layer of the ink jet recording material has a surface thereof having no tackiness and can record thereon ink images having high gloss and excellent clarity.

The cellulose derivatives such as hydroxypropylmethylcellulose are usable for various uses, for example, as a thickener or adhesive for foods, medicines, cosmetics and building materials. The usual cellulose derivatives for the above-mentioned uses have an extremely high viscosity. The hydroxy-propylmethylcellulose usable for the present invention is limited to one having a viscosity of 200 cP or less, preferably 100 cP or less, determined in a 2% aqueous solution thereof at a temperature of 20° C., by a B-type viscometer.

When the viscosity of the 2% aqueous solution of the hydroxypropylmethylcellulose is more than 200 cP, the resultant coating liquid for the ink receiving layer exhibits an unsatisfactory leveling property and the resultant ink receiving layer has streaks formed due to the high viscosity of the coating liquid. Also, when the concentration of the cellulose derivatives in the coating liquid is decreased to reduce the viscosity of the coating liquid, the thickness of the coating layer obtained by one coating operation is too small. Therefore, to form an ink receiving layer capable of receiving ink images having a high clarity without blotting of the ink even when the ink images are formed from two or more inks different in color from each other, the diluted coating liquid must be coated twice or more. This causes the coating operation to be complicated and the coating cost to be high.

The inventors of the present invention made a comparison of various aqueous resins with each other in applicability to the aqueous pigment ink. As a result, it has been formed that by using the hydroxypropylmethylcellulose (HPMC) which is one of the water-soluble cellulose derivatives, the resultant ink receiving layer can receive thereon ink images having no blotting no cracking of the ink images and a high uniformity in solid print. Also, the resultant ink receiving layer has a good ink-drying property and a high resistance to formation of a wetted and tacky print surface.

When the ink jet recording is carried out by using a pigment ink, the HPMC preferably exhibits a viscosity of 20 to 200 cP determined in a 2% aqueous solution thereof at a temperature of 20° C. by using the B-type viscometer. When the 2% aqueous solution of the HPMC exhibits a viscosity less than 20 cP at 20° C., and the resultant ink receiving layer is printed with the aqueous pigment ink, remarkable cracks may be formed in the resultant pigment ink images. Also, when the 2% aqueous solution of the HPMC has a viscosity more than 200 cP, the resultant coating liquid for the ink receiving layer has too high a viscosity, is difficult to handle and exhibits a reduced coating efficiency. Also, the resultant ink receiving layer has coating defects. When the concentration of the HPMC in the coating liquid is reduced to improve the coating efficiency, the resultant diluted coating liquid must be repeatedly coated to obtain an ink receiving layer having a desired coating amount. The repeated coating operations causes the coating efficiency to reduce and the coating cost to increase.

Further, in the hydroxypropylmethylcellulose usable for the present invention, the methoxy group-substitution degree of the HPMC (which corresponds to an average number of the methoxy groups by which the hydroxyl groups are substituted per cyclic glucose unit in the cellulose structure) is preferably 1.5 or more, more preferably 1.7 or more, still more preferably 1.8 or more. When the HPMC having a methoxy group-substitution degree of 1.5 or more is used, an ink receiving layer has an excellent ink absorption and a high gloss, and the resultant ink images have a high color density. When the methoxy group-substitution degree is less than 1.5, the resultant ink receiving layer may have an unsatisfactory transparency and an insufficient gloss. There is no upper limit to the methoxy group-substitution degree. Since the number of the hydroxyl groups per cyclic glucose unit is 3, the methoxy group-substitution degree must be less than 3.

The average addition mole number of the hydroxylpopyl groups per cyclic glucose unit of the HPMC is not limited to a specific range. Usually, the average hydroxypropyl group addition mole number is preferably in the range of from 0.10 to 0.34, more preferably from 0.10 to 0.30.

The inventors of the present invention have found that when the HPMC is used, and even when a dye ink is used for ink jet recording, the resultant ink receiving layer can evenly form thereon aqueous dye ink images having a high gloss without blotting the aqueous dye ink around the images. Also, the aqueous dye ink images formed on the ink receiving layer exhibit a high ink drying property and a satisfactory resistance to the formation of the wetted and tacky print surface.

There is no limitation to the weight average molecular weight of the hydroxypropylmethylcellulose. Usually, the weight average molecular weight of the HPMC usable for the present invention is in the range of from 80,000 to 170,000.

When the ink receiving layer comprising the specific HPMC is printed with an aqueous dye ink, and the printed ink jet recording material is exposed to a low temperature atmosphere or to a high humidity environment, a phenomenon that the ink images are partially whitened may occur in response to the type of the aqueous dye ink.

The whitening phenomenon of the dye ink images can be prevented by adding an N-vinyl pyrrolidone resin (B) to the hydroxypropylmethylcellulose (A) for the ink receiving layer. The N-vinyl pyrrolidone resin (B) comprises at least one member selected from homopolymers of N-vinyl pyrrolidone and copolymers of N-vinyl pyrrolidone with at least one other polymerizable monomer.

When a dye ink is used for the ink jet recording, the homopolymers of N-vinyl pyrrolidone and copolymers of N-vinyl pyrrolidone with at least one other polymerizable monomer preferably have an weight average molecular weight of 500,000 or less, more preferably 5,000 to 500,000. When the molecular weight is less than 5,000, the resultant ink receiving layer may exhibit a reduced resistance to blotting of the ink images. When the molecular weight is more than 500,000, the resultant N-vinylpyrrolidone resin (B) may exhibit a poor compatibility with the HPMC and thus the resultant ink receiving layer may exhibit an unsatisfactory gloss.

In the ink receiving layer of the present invention, the N-vinyl pyrrolidone resin (B) comprising at least one member selected from homopolymers of N-vinyl pyrrolidone and copolymers of N-vinyl pyrrolidone with at least one other polymerizable monomer is preferably present in an amount of 5 to 150 parts by weight, more preferably 10 to 80 parts by weight, per 100 parts by weight of the HPMC. When the amount of the N-vinyl pyrrolidone resin (B) is less than 5 parts by weight, the ink images formed on the resultant ink receiving layer may be unsatisfactory in the level of the gloss. Also, when the amount of the N-vinyl pyrrolidone resin (B) is more than 150 parts by weight, the compatibility of the N-vinyl pyrrolidone resin (B) with the HPMC is reduced, and the gloss of the resultant ink receiving layer decreases. Particularly, when the aqueous ink containing a dye as a coloring material is used, the amount of the N-vinyl pyrrolidone resin (B) contained in the ink receiving layer is preferably 10 to 40 parts by weight per 100 parts by weight of the HPMC.

In the present invention, it has been further found that the addition of the N-vinyl pyrrolidone resin (B) comprising at least one member selected from the homopolymers of N-vinyl pyrrolidone and the copolymers of N-vinyl pyrrolidone with at least one other polymerizable monomer to the HPMC contributes to enhancing the applicability of the aqueous pigment ink to the resultant ink receiving layer. Namely, addition of the N-vinyl pyrrolidone resin (B) to the HPMC, the resistance of the aqueous pigment ink images formed on the resultant ink receiving layer to cracking can be further enhanced, and the color density and gloss of the ink images can be improved.

There is no limitation to the composition of the N-vinyl pyrrolidone resin (B). The N-vinyl pyrrolidone homopolymers are poly N-vinyl pyrrolidones (PVP), and the N-vinyl pyrrolidone copolymers include N-vinyl pyrrolidone-vinyl acetate copolymers, N-vinyl pyrrolidone-cationic monomer copolymers, for example, N-vinyl pyrrolidone-quaternary methyl-vinyl imidazolium copolymers, and N-vinyl pyrrolidone-acrylic acid copolymers.

Among the homopolymers and copolymers as mentioned above, the PVP has a high effect on the improvement of the resistance of the aqueous pigment ink images to cracking and in preferably used for the present invention.

When the aqueous pigment ink is used, the N-vinyl pyrrolidone homopolymers and copolymers preferably have a weight average molecular weight of 5,000 to 100,000, more preferably 6,000 to 50,000. When the molecular weight of the N-vinyl pyrrolidone homopolymers and copolymers is less than 5,000, and the resultant ink receiving layer is printed with an aqueous dye ink, the printed ink may remarkably blot. Also, when the molecular weight is more than 100,000, the resultant ink receiving layer may exhibit an unsatisfactory enhancing effect on the resistance of the aqueous pigment ink images formed thereon to cracking.

The N-vinyl pyrrolidone resin (B) is added in the above-mentioned amount to the HPMC. When the amount of the N-vinyl pyrrolidone resin (B) is too small, a satisfactory cracking resistance of the pigment ink images may not be obtained. Also, when the amount of the N-vinyl pyrrolidone resin (B) is too large, the blotting resistance of the ink images, the ink-drying property and the resistance to the wetted and tacky surface formation may be unsatisfactory. Also, the ink receiving layer of the present invention comprising the HPMC and the N-vinyl pyrrolidone resin (B) can receive the aqueous dye ink images evenly and without blotting the ink, and the resultant ink images exhibit satisfactory color density, gloss and ink-drying property.

The reasons for the phenomenon that the polymeric composition for the ink receiving layer of this embodiment exhibits an enhanced receiving property for the aqueous pigment ink are not fully clear but the reasons are assumed to be as follows. Generally, when an aqueous dye ink in which a water-soluble dye is dissolved in an aqueous medium (for example, water or an aqueous solution of a small amount of an alcohol compound, for example, glycol) is applied to an ink receiving layer, the dye which is used as a coloring material easily penetrate, together with the aqueous medium, into the ink receiving layer. However, when an aqueous pigment ink in which a coloring pigment is dispersed in the form of fine solid particles in an aqueous medium, is applied to the ink receiving layer, the pigment particles deposit and are fixed on the surface of the ink receiving layer, to form a pigment layer, while the aqueous medium easily penetrates into the inside of the ink receiving layer. Thus, the dispersion of the pigment particles retained on the ink receiving layer surface becomes unstable with drying of the pigment particle dispersion, and the pigment particles are easily aggromelated with each other to form a pigment layer on the ink receiving layer surface. Since the ink receiving layer swells with the absorption of the aqueous medium of the ink. Therefore, the images formed by the coloring pigment layer are finely cracked due to the expansion of the ink receiving layer.

The HPMC for the present invention has a higher viscosity than that of other water-soluble resins, for example, polyvinyl alcohol and the vinyl pyrrolidone polymer, and thus exhibits a high activity for restricting the agglomeration of the pigment particles. Also, since the HPMC for the present invention has a high viscosity, the resultant ink receiving layer has a high adhesion force to the support. Also, the ink medium is taken in the ink receiving layer in the direction of thickness rather than in the directions parallel to the surface of the ink receiving layer. Thus, the swelling of the ink receiving layer in the thickness direction is large and the swelling in the directions parallel to the surface of the ink jet receiving layer is small. Therefore, the cracking of the ink images is difficult to occur rather than the other water-soluble resin.

In the ink receiving layer of the embodiment, the N-vinyl pyrrolidone resin (B) usable together with the HPMC has a relatively low molecular weight and is easy soluble in water. Thus, it is assumed that when the aqueous pigment ink is applied to the ink receiving layer, the aqueous medium is rapidly absorbed by the N-vinyl pyrrolidone resin (B) in the ink receiving layer, and then gradually penetrates into the HPMC. Therefore, the swelling of the ink receiving layer of the present invention containing the HPMC and the N-vinyl pyrrolidone resin (B) is smaller than the swelling of the ink receiving layer containing the HPMC and free from the N-vinyl pyrrolidone resin (B). Also, the N-vinyl pyrrolidone resin (B) contributes to preventing or restricting the aggromelation of the pigment particles on the surface of the ink receiving layer. This effect may be derived from a bleeding of the N-vinyl pyrrolidone resin (B) to the surface of the ink receiving layer.

Therefore, the cracking of the ink images formed from the aqueous pigment ink can be completely prevented by the presence of the N-vinyl pyrrolidone resin (B) in the ink receiving layer. Also, the resultant ink images have excellent gloss.

The coating liquid composition for forming the ink receiving layer optionally contains an additional aqueous resin, as long as the effect of the present invention is not obstructed. The additional aqueous resin include water-soluble resins and water-dispersible resins.

The water-soluble resins are selected from, for example, polyvinyl alcohols, modified polyvinyl alcohols, for example, cation-modified polyvinyl alcohols, silyl-modified polyvinyl alcohols, water-soluble acrylic resins, casein, starch, starch derivatives, for example, oxidized starches and cationic starches, water-soluble cellulose derivatives other than the hydroxypropylmethylcellulose, polyacrylic acids, polyacrylate metal salts, polyacrylamides, polyethyleneoxides, polyethyleneglycoles, polyvinylmethylethers, gelatin, chitin and chitosan. The above-mentioned aqueous resins may be contained in the ink receiving layer. Also, the water-dispersible resins include, for example, aqueous emulsions of polymeric resins prepared by polymerizing polymerizable monomers in an aqueous medium optionally in the presence of an emulsifying agent, and water-dispersed resins prepared by forcibly dispersing polymeric resins in an aqueous medium optionally after the polymeric resins are modified with hydrophylic groups.

The polymeric resins for the water-dispersible resins include, for example, conjugated diene polymers, for example, styrene-butadiene copolymers, methyl methacrylate-butadiene copolymers, acrylic resins, for example, acrylate ester polymers and methacrylate ester polymers, vinyl polymers, for example, polyvinyl acetate and ethylene-vinyl acetate copolymers, polyester resins, urethane polymers, and polyolefin resins.

Further, the ink receiving layer of the present invention optionally comprises an urethane resin for the purpose of enhancing the water resistance thereof. There is no limitation to the type of the urethane resin. The urethane resin include ones forcibly emulsified with an emulsifying agent and ones modified to be water-soluble or self-dispersible resins by substituting the urethane resins with certain hydrophylic groups. However, in the case of a thermo-reactive urethane resins having block isocyanate groups attached to the methane skeleton, the water resistance of the resin may increase with the lapse of time and the ink-absorption of the resin may decrease. Therefore, the urethane resins for the present invention are preferably selected from non-reactive urethane resins.

There is no limitation to the content of the urethane resin in the ink receiving layer. Usually, the urethane resin is preferably contained in an amount of 30 parts by weight or less, more preferably 5 to 25 parts by weight, per 100 parts by weight of the hydroxypropylmethylcellulose, in the ink receiving layer. If the content of the urethane resin is more than 30 parts by weight, the resultant ink receiving layer may exhibit unsatisfactory ink-absorption and transparency.

The above-mentioned aqueous resins are employed alone or in a mixture of two or more thereof.

The coating liquid composition for the ink receiving layer optionally contains a cationic resin, as long as the effect of the present invention is not obstructed, to enhance the water resistance of the printed ink images. The effect of the cationic resin is significantly exhibited when the aqueous dye ink is used. However, when the content of the cationic resin is too high, the resultant ink receiving layer may exhibit a reduced ink-drying property and a decreased sheet gloss. Also, since the cationic resin may cause the ink images formed from the aqueous pigment ink on the resultant ink receiving layer to exhibit a reduced resistance to cracking of the ink images, the content of the cationic resin in the ink receiving layer is preferably controlled to the range as mentioned below. When the content of the cationic resin is too high, the resultant pigment ink images may exhibit a reduced resistance to cracking and the resultant ink receiving layer may have a wetted and tacky surface.

The cationic resins usable for the present invention include, for example, various types of resins capable of reacting with sulfon groups and carboxyl groups of the dyes and pigments contained in the aqueous inks for the ink jet recording, to form water insoluble salts of the resins, and cationic resins having secondary amino groups, tertiary amino groups or quaternary ammonium salt groups. For example, the cationic resin comprises at least one member selected from, for example, polyethyleneimine, polyvinylpyridine, polyvinylamine, monoallylamine-hydrochloric acid salt polymer, diallylamine-hydrochloric acid salt polymer, monoallylamine-hydrochroric acid salt-diallylamine-hydrochloric acid salt copolymers, (meth) acrylamide alkyl quaternary ammonium salt polymers, polyalkylenepolyamine-dicyandiamide condensation products, secondary amine-epichlorohydric condensation polymers, polyexpoxyamines, polydimethyldiallyl ammonium chloride, poly(allylamine hydrochloric acid salt), allylamine-diallylamine copolymers, (meth)acrylamide-diallylamine copolymers, acrylamide-dimethyldiallylamine copolymers, epichlorohydric polyamides, polydialkylaminoethylacrylamides, dicyandiamidepolyethyleneamines and polydimethylamineammonium epichlorohydrin.

Preferably, cationic resin comprising a copolymer of a polyalkylenepolyamine with dicyandiamide is employed for the present invention, because this type of cationic resin is useful for producing an ink jet recording material having a higher water resistance and capable of recording thereon ink images having a higher color density than those derived from the other cationic resins. Also, the allylamine-diallylamine copolymers which contribute to enhancing the water resistance of the ink images and the addition polymerization products of secondary amines with an epihalohydrin, for example, epichlorohydrin can be employed alone or in a mixture of two or more thereof in the ink receiving layer. Also, (meth)acrylamidediallylamine copolymers are preferably employed.

The cationic resin is preferably contained in a content of 1 to 30 parts by weight, more preferably 1 to 20 parts, by weight still more preferably 1 to 10 parts by weight, per 100 parts by weight of the hydroxypropylmethylcellulose, in the ink receiving layer. When the content of the cationic resin is less than 1 part by weight, the water resistance-enhancing effect of the cationic resin may not be fully exhibited. When the cationic resin content is more than 30 parts by weight, the gloss of the ink images formed on the resultant ink receiving layer and the ink drying property of the ink receiving layer may be reduced.

For the purpose of preventing the tacky surface formation and blocking of the feed of the recording materials, or of controlling the gloss and transparency of the ink receiving layer, various inorganic and organic pigments and other particulate materials are optionally contained in the ink receiving layer. The inorganic pigment preferably comprises at least one member selected from, for example, silica, clay, talc, calcium carbonate, aluminum silicate, zeolite and alumina. The organic pigments and other particulate materials include, for example, various grades of plastic resin particles, for example, particles of styrene resins, acrylic resins and urethane resins, and fine cellulose powder and starch powder.

There is no limitation to the content of the pigments and the other particulate materials. Usually, the pigments and the other particulate materials are preferably contained in a content of 20 parts by weight or less, more preferably 10 parts by weight or less, but not less than 0.1 part by weight per 100 parts by weight of the HPMC in the ink receiving layer. When the content is less than 0.1 part by weight, the effect of the pigments and the other particulate materials may not be exhibited. Also, when the content is more than 20 parts by weight, the ink images formed on the resultant ink receiving layer may exhibit a reduced gloss and color density.

Further, the coating liquid composition for the ink receiving layer of the present invention optionally contains at least one additive selected from, for example, dispersing agents, crosslinking agents, thickening agents, anti-foaming agents, wetting agents, fluorescent dyes, coloring materials, antistatic agents, preservatives and ultraviolet ray-absorbing agents.

The support usable for the present invention is not limited to specific type of supports. To obtain a sheet capable of recording ink images having a high gloss or a recording material having a high gloss, various types of paper sheets, for example, woodfree paper sheets, middle grade paper sheets, coated paper sheets, art paper sheets and cast-coated paper sheets, synthetic paper sheets, white-colored plastic films, laminate sheets, transparent plastic films and semi-transparent plastic films can be used. In this case, by forming an ink receiving layer which is transparent and in which the diffused reflection of light at the inside and surface thereof is small, the resultant ink jet recording material capable of recording ink images having a high color density and exhibiting a high gloss. To cause the ink receiving layer to exhibit an enhanced gloss with a high efficiency, the support for the ink receiving layer is preferably formed from a material which can form a firm barrier against the coating liquid composition for the ink receiving layer. For example, for the support usable for the present invention, white opaque plastic films made from a polyethylene terephthalate, polyvinyl chloride, polycarbonate, polyimide, polyvinyl acetate, polyethylene, polypropylene or polystyrene resin which is made opaque and whitened by mixing a pigment, for example, titanium dioxide or barium sulfate or by forming a plurality of pores in the film, or laminate sheets in which base paper sheets are laminated with thermoplastic resins, for example, polyethylene or polypropylene resins. In the laminate sheets, the laminate layer must be formed on at least a surface side of a base paper sheet on which side the ink receiving layer is formed. The laminate layer optionally contains a pigment, for example, titanium dioxide or barium sulfate to improve the whiteness and opaqueness of the support or a coloring dye, coloring pigment or fluorescent brightening agent to adjust the apparent whiteness and hue of the support to as desired. Also, the laminate sheet optionally has a back laminate layer to prevent the generation of curl. Further, after the ink receiving layer is coated on the support, the resultant coated sheet is optionally subjected to a calendar treatment to enhance the smoothness and gloss of the surface of the ink receiving layer.

In the ink jet recording material, when the support is formed from a paper sheet, for example, woodfree paper sheet or middle grade of paper sheet, a mat-like coated paper sheet or a mat-like laminate sheet, to control the surface roughness of the support, an ink jet recording material having a semi-gloss paper-like hand and appearance can be produced.

The paper sheets usable for the support are pulp sheets comprising, as a principal component, a wood pulp. The wood pulp is selected from, for example, chemical pulps, for example, LBKP and NBKP, mechanical pulps, for example, GP, PGW, RMP, TMP, CTMP, CMP and CGP, and used paper pulps, for example, DIP. The pulp is optionally added with conventional additives for paper-forming. The additives for paper-forming include, for example, various types of pigments, binders, sizing agents, fixing agents, yield-enhancing agents, cationizing agents, dry paper strength-enhancing agents, wet paper strength-enhancing agents, pH-regulating agent, electroconductive agents, and dyes. These additives may be used alone or in a mixture of two or more thereof. The paper machine may be selected from conventional wire paper machines, cylinder paper-forming machines, twine wire paper-forming machines. The paper-forming method may be an acid, neutral or alkaline paper-forming method.

The resultant paper sheet for the support may be tub-sized or size-pressed with starches or polyvinyl alcohols, or surface-smoothed by a machine calendar, heat-calendar, soft calendar or super calendar.

The polyolefin resin-coating layer for the support is formed by coating a surface of the base sheet of the support with a melt of a resin composition comprising, as a principal component, a polyolefin resin and optionally a white pigment and/or an additive. The polyolefin resin usable for the present invention is selected from, for example, homopolymers and copolymers of ethylene and propylene. These resins can be used alone or in a mixture of two or more thereof. Among these resins, low density polyethylene, moderate density polyethylene, high density polyethylene, linear low density polyethylene and polypropylene resin are easy to process and are readily available, and thus are advantageously utilized for the support.

There is no specific limitation to the physical properties of the polyolefin resins. Usually, in consideration of processability and curl-resistance, the polyolefin resins for the support preferably have a number average molecular weight of 20,000 to 200,000, a specific gravity of 0.915 to 0.950 g/cm$^3$ and a melt index of 2 to 40 g/10 minutes, which are determined in accordance with JIS K 6760.

The polyolefin resin coating layer of the support optionally contains a white pigment and various additives. Particularly, to enhance the whiteness and the opaqueness of the polyolefin resin coating layer, the white pigment is preferably contained in the layer.

The white pigments usable for the present invention preferably comprise one or more members selected from, for example, anatase titanium dioxide, rutile titanium dioxide, zinc oxide, calcium carbonate, and talc. The white pigment is used in an amount of 0.1 to 30 parts by weight per 100 parts by weight of the polyolefin resin. When the content of the white pigment is less than 0.1 part by weight, the increase in the whiteness and opaqueness of the coating layer may be insufficient. Also, when the content is more than 30 parts by weight, the white pigment may be difficult to uniformly disperse in the polyolefin resin. Preferably, the content of the white pigment in the polyolefin resin is 1 to 15 parts by weight per 100 parts by weight of the polyolefin resin. In consideration of the whiteness and opaqueness-enhancing effect, the white pigment preferably comprises anatase and/or rutile titanium dioxide.

The polyolefin resin coating layer optionally contains, in addition to the white pigment, at least one additive selected from, for example, coloring pigments, coloring dyes, fluorescent brightening agents, antioxidants, plasticizers and dispersing agents.

The polyolefin resin can be mixed with the white pigment and the additive by using an extruder for kneading, a heat roll kneader, a Bunbury's mixer or a pressure kneader.

The polyolefin resin coating layer is formed by an extrusion-coating method. Namely, a base sheet is continuously fed into a melt-extruder, a melt of a polyolefin resin composition is extruded through a film-forming slit die, and the extruded film-formed stream of the polyolefin resin composition melt is coated on a surface of a travelling base sheet. In this coating procedure, the temperature of the film-formed melt stream is established in response to the type of the resin. Usually, the melt temperature is 200° C. to 350° C. The slit die is preferably selected from T-die, L-die, fish tail die and flat die. The opening width of the slit die is preferably 0.1 to 2 mm. To obtain a desired center line mean roughness of the polyolefin resin coating layer surface, a cooling roll for the coated resin melt layer on the base sheet is preferably selected from cooling rolls having a high smoothness surface formed, for example, as a mirror finish. Also, the cooling roll for the back coating layer formed from a polyolefin resin composition melt may be the same as that for the front coating layer or may be selected from those having a rough-finished cooling roll surface.

The back surface of the support opposite to the surface on which the ink receiving layer is coated is optionally coated with a polyolefin resin coating layer to control the curling of the ink jet recording material.

The polyolefin resin coating layer is formed in an amount of 5 g/m$^2$ to 50 g/m$^2$ on each of the front and back surfaces of the base sheet. When the amount of the polyolefin resin coating layer is less than 5 g/m$^2$, the resultant coating layer may exhibit an insufficient adhesion to the base sheet and the resultant ink jet recording material may exhibit an unsatisfactory gloss. Also, when the amount of the coating layer is more than 50 g/m$^2$ the resultant ink jet recording sheet may be too thick and the cost may be increased without advantage. Preferably, the amount of the polyolefin resin coating layer is in the range of from 10 g/m$^2$, to 30 g/m$^2$.

In the present invention, the ink receiving layer and the back coating layer may be directly coated on the support. However, to enhance the adhesion of the ink receiving layer or the coating layer to the support, the coating surfaces of the support may be subjected to a surface-activation treatment, for example, a corona discharge treatment or flame treatment, or may be coated with an undercoat layer.

Also, it is possible to impart a semi-gloss appearance to the resultant ink jet recording material surface by controlling the surface roughness of the base sheet or of the resin coating layer of the support.

In the ink jet recording material of the present invention, since the ink receiving layer is transparent, when a transparent support is used, the resultant ink jet recording sheet is suitable as a light-permeable recording medium and, for example, a recording sheet for OHP. The transparent support is preferably selected from plastic films, for example, polyethylene terephthalate, polyvinyl chloride, polycarbonate, polyimide, polyvinyl acetate, polyethylene, polypropylene, and polystyrene films. In this case, the degree of cloudiness or haze of the entire ink jet recording material including a transparent support, an ink receiving layer and optionally a back coating layer (curl-preventing layer) is preferably 10% or less, determined in accordance with Japanese Industrial Standard (JIS) K 7105. When the degree of cloudiness is more than 10%, the clarity and sharpness of OHP project images may be low. There is no limitation to the thickness of the support. Usually, in consideration of easy in handling and cost, the support for the present invention preferably has a thickness of 25 to 500 $\mu$m, more preferably 50 to 300 $\mu$m.

There is no specific limitation to the solid content of the coating liquid composition of the ink-receiving layer.

The solid content is variable in response to the type of coating method and is preferably controlled to a level of 4 to 50% by weight, more preferably 5 to 20% by weight. The coating liquid composition for the ink receiving layer comprising the above-mentioned components is coated on the support by a conventional coating means for example, a bar coater, a blade coater, an air knife coater, a roll coater, a gravuer coater, a rod blade coater, an extrusion coater, a slid hopper, a short dwell coater, a curtain coater or a die coater, and is dried. The dried coating liquid composition layer formed on the support is preferably in an amount of 1 to 50 g/m$^2$, more preferably 3 to 30 g/m$^2$, still more preferably 5 to 30 g/m$^2$. When the dry amount of the coating liquid composition layer is less than 1 g/m$^2$, the resultant ink receiving layer may exhibit an insufficient ink absorption, and the ink images may blot and exhibit a low ink drying rate. Also, if the dry amount is more than 50 g/m$^2$, the ink-receiving property of the ink receiving layer saturates and the resultant ink jet recording material may have a high cost and exhibit an increased curling property.

Particularly, when the coating is carried out by a die coater, coating defects, for example, repelling of the coating liquid, coating unevenness, coating gaps, spots, and streaks, can be prevented, a coating liquid composition having a high viscosity can be coated in a large amount on the support, and the resultant ink receiving layer has a uniform thickness, an even appearance and exhibits a high gloss. Therefore, the resultant ink images have high and uniform color density, clarity and gloss.

In the die coater, a coating liquid composition is coated in an amount established in consideration of the liquid feed rate of a pump and a pressure tank, the opening width of the die lip and the gap between the support sheet and the die head, on a support consisting of a paper sheet or film and supported on a backing roll through a die lip. This die-coater is a pre-dose feeding, non-contact coating apparatus in which a coating liquid is applied in a predetermined, measured amount, but not a coating apparatus in which a coating liquid is applied in a large amount and then the a portion of the resultant coating layer is removed. In the die coating method, when the solid amount of the coating liquid composition is increased, the coating amount can be increased, and the drying efficiency is enhanced. However, the increase in the concentration causes the viscosity of the coating liquid to increase. Therefore, when the coating liquid is applied by using a conventional coating apparatus, for example, a bar coater, a blade coater, a gravure coater, a roll coater, or an air knife coater, the resultant coating layer may have bar traces, streaks, gravure patterns, roll patterns and/or may be unevenly formed, and when a certain coater is used, the coating procedure may not be carried out. Also, when the above-mentioned coating apparatus is employed, and the coating liquid is vigorously agitated during the coating procedure, or is recycled and re-used, foams are inevitably formed in the coating liquid.

The foam may cause a streak-formation or an uneven coating. When the die coater is used, the coating liquid preferably has a viscosity of 500 to 15,000 cP, more preferably 1,000 to 8,000 cP determined by a Brookfield-type viscometer.

When the viscosity is too low, the resultant coating layer may have too small a coating amount, and/or the load necessary to dry the coating liquid layer becomes too high. When the viscosity is too high, uneven coating may occur and/or coating gaps may be formed.

The viscosity of the coating liquid can be controlled to a desired level in response to the composition of the coating liquid, namely the types and mixing ratio of the components and the total concentration of the coating liquid. Usually, the concentration of the coating liquid is preferably 4 to 50% by weight, more preferably 6 to 30% by weight.

The gloss at an angle of 75 degrees of the surface of the high gloss grade ink jet recording material of the present invention produced by the above-mentioned procedures is variable in response to the use and grade thereof. Preferably, the gloss is 40% or more, more preferably 70% or more, still more preferably 80% or more. To form the ink images is highest quality, the gloss is preferably 80% or more.

To prevent or restrict the generation of curling on the ink jet recording material of the present invention, a curl-preventing layer may be formed on a surface of the support opposite to the surface on which the ink receiving layer is formed. In this case, there is no limitation to the curl-preventing layer composition. Usually, since the curl is considered to generated by absorption and desorption of moisture in the ink receiving layer in response to the change of humidity, it is advantageous that the curl-preventing layer has a composition similar to that of the ink receiving layer.

An embodiment of the ink jet recording material of the present invention having high gloss is explained hereinbefore.

In another embodiment of the ink jet recording material of the present invention having a hand and appearance similar to those of a semi-gloss grade of conventional silver salt photographic printing paper sheet, and exhibiting a high ink absorption and a high resistance to blotting of ink will be illustrated below.

In the embodiment of a semi-gloss grade ink jet recording material of the present invention, the support comprises a polyolefin resin-laminated paper sheet having a center line mean roughness Ra of 0.5 $\mu$m or less; and the ink receiving layer comprises at least the hydroxy-propylmethylcellulose (A) and pigment particles having an average particle size of 1 to 30 $\mu$m, the pigment particles having an average particle size of 1 to 30 $\mu$m being present in a content of 1 to 10 parts by weight per 100 parts by weight of the total weight of the ink receiving layer;

the ink receiving layer being present in a dry weight of 3 to 20 g/m$^2$, and the ink jet recording material having an ink jet recording surface exhibiting a mirror surface gloss at an angle of 75 degrees of 20 to 60%, determined in accordance with JIS P 8142. This type of the ink jet recording material of this embodiment exhibits a hand and appearance similar to those of the semi-gloss grade of photographic printing paper sheet.

In the embodiment, the ink receiving layer comprises hydroxypropylmethylcellulose and a N-vinyl-pyrrolidone resin comprising at least one member selected from homopolymers of N-vinyl pyrrolidone and copolymers of N-vinyl pyrrolidone with at least one other polymerizable monomer, especially an ethylenically unsaturated monomer other than and copolymerizable with N-vinyl pyrrolidone.

The ink receiving layer optionally comprises, in addition to the hydroxypropylxymethylcellulose and the N-vinyl pyrrolidone resin, the above-mentioned water-soluble resin and/or the above-mentioned water-dispersible resin, as long as the ink receiving performance of the ink receiving layer is not obstructed.

There is no limitation to the pigment as long as the desired gloss of the ink jet recording layer can be obtained. For example, the pigment preferably comprises at least one member selected from inorganic pigments, for example, synthetic amorphous silica, colloidal silica, precipitated calcium carbonate, ground calcium carbonate, magnesium carbonate, alumina, kaolin, clay, satin white, diatomaceous earth, calcium sulfate, barium sulfate, calcium silicate, magnesium silicate, titanium dioxide, magnesium hydroxide, synthetic zeolite, zinc oxide, zinc sulfide and, zinc cabonate; and organic pigments, for example, styrene plastic polymer pigments, acrylic plastic resin pigments, microcupsules, corn starch particles, potato starch particles and modified starch particles. The pigment particles has an average particle size of 1 to 30 $\mu$m, preferably 3 to 15 $\mu$m. Preferably, the inorganic pigments are employed for the present invention. Especially, the amorphous silica produced by a precipitation method or a gel method is preferred because the resultant ink receiving layer can form ink images having a bright color and exhibit an enhanced ink absorption.

In the ink receiving layer, the pigment particles having the average particle size of 1 to 30 μm are preferably contained in a content of 1 to 10 parts by weight, more preferably 1 to 8 parts by weight per 100 parts by weight of the ink receiving layer. When the pigment content is less than 1 part by weight, the gloss of the ink receiving layer may be difficult control to a desired semi-gloss level. Also, when the content of the pigment particles having an average particle size of 1 to 30 μm is more than 10 parts by weight, the resultant ink receiving layer may exhibit substantially no gloss.

The cationic resin which may be contained in the ink receiving layer serves as an ink-fixing agent. The cationic resin may be selected from those as mentioned above.

The ink receiving layer of the present invention optionally contains at least one of pigment-dispersing agents, thickness and fluidity-enhancing agent, anti-foaming agents, foam-inhibiting agents, release agents, foaming agents, penetrating agent, coloring dyes, coloring pigments, fluorescent brightening agents, ultraviolet ray-absorbers, antioxidants, preservatives, mildew-proofing agents and water-proofing agents.

In the present invention, the ink receiving layer is preferably formed in a dry weight of 3 to 20 g/m$^2$, more preferably 5 to 18 g/m$^2$. When the dry weight is less than 3 g/m$^2$, the resultant ink receiving layer may not fully absorb full color inks applied thereto. Also, when the dry weight is more than 20 g/m$^2$, the resultant ink jet recording material may be too thick and exhibit a reduced resistance to curling and an economical disadvantage in high cost.

The surface of the ink jet recording material of the present invention preferably has a mirror surface gloss of 20 to 60%, more preferably 25 to 60%, determined at an angle of 75 degrees in accordance with JIS P 8142. When the gloss is less than 20%, the recording surface of the resultant ink jet recording material may exhibit an unsatisfactory gloss in the naked eye observation. Also, if the gloss is more than 60%, the gloss of the ink receiving layer may exceed the grade of semi-gloss, and may reach a high gloss grade.

The semi-gloss grade ink receiving layer of the present invention can be formed by the above-mentioned coating methods.

The substrate sheet for the semi-gloss grade ink jet recording material of the present invention comprises a polyolefin resin-coated paper sheet having a base paper sheet and at least one polyolefin resin coating layer formed on at least a surface of the base paper sheet on which the ink receiving layer is formed. There is no limitation to the thickness of the base paper sheet. Preferably the thickness of the base paper sheet is 30 to 500 μm, more preferably 50 to 300 μm. When the thickness is less than 30 μm, the resultant ink jet recording material may have an insufficient stiffness and may exhibit unsatisfactory hand, weight, and opaqueness.

When the thickness is more than 500 μm, the resultant recording material may be too rigid and difficult to handle, and may cause troubles in feeding and travelling through the printer. There is no limitation to the basis weight of the base paper sheet. Preferably, the basis weight of the base paper sheet is 30 to 500 g/m$^2$, more preferably 50 to 300 g/m$^2$.

The base paper sheet comprises, as a principal component, a wood pulp.

The wood pulp may be selected from those as mentioned hereinbefore. Optionally, the base paper sheet contains conventional additives for the paper-forming procedures.

The base paper sheet is optionally tub-sized or sizepressed with starches or polyvinyl alcohols, and/or surface-smoothed by using a machine calendar, heat calendar, soft calendar or super calendar.

The polyolefin resin laminating layer is formed by extrusion-coating the base paper sheet with a resin composition comprising, as a principal component, a polyolefin resin and optionally white pigments and conventional additives.

The polyolefin resin may be selected from those as mentioned hereinbefore.

The polyolefin resin laminating layer optionally contains white pigments and/or additives. Particularly, the front polyolefin resin laminating layer preferably contains the white pigment to enhance the whiteness and opaqueness of the substrate.

The white pigment usable for the present invention include anatase titanium dioxide, rutile titanium dioxide, zinc oxide, calcium carbonate, and talc. These pigments may be employed alone or an a mixture of two or more thereof. To obtain a polyolefin resin-coated substrate paper sheet having a desired center line mean roughness Ra, preferably, the particles of the white pigment has an average particle size of 1 μm or less, more preferably 0.5 μm or less, still more preferably 0.1 to 0.3 μm.

In the preparation of the polyolefin resin laminating layer, the white pigment is preferably contained in a content of 0.1 to 30 parts by weight per 100 parts by weight of the polyolefin resin.

The white pigment particles are optionally surface-treated with aluminum or silicon.

The additive for the polyolefin resin coating layer is preferably selected from coloring dyes, coloring pigments, fluorescent brightening agents, antioxidants, plasticizers, and dispersing agents.

The mixing of the polyolefin resin with the white pigments and/or the additives is carried out by using a knead-extruder, a heat roll-kneader, a Bunbury's mixer, or a press-kneader.

The polyolefin resin coating layer is formed by an extrusion-coating method. Namely, a melt of a polyolefin resin composition is spread and coated in the form of a film on at least one surface continuously fed to a melt-extruder through a slit die of the extruder.

The temperature of the film-formed stream of the polyolefin resin composition melt is variable in response to the type of the resin. Usually, the melt temperature is 200 to 350° C. The slit die is preferably selected from a T die, an L die, a fish tail die or a flat dye. The opening width of the slit die is preferably 0.1 to 2 mm.

To obtain an ink jet recording material of the present invention having the derived center line mean roughness Ra, the cooling roll for cool-solidifying the front resin melt film layer on the base paper sheet is preferably selected from cooling rolls with a peripheral cooling surface having a high smoothness. For example, cooling rolls having mirror-finished peripheral surface plated with chromium and having a high smoothness, or cooling rolls preferably having a center line mean roughness Ra of 1.0 μm or less, more preferably 0.5 μm or less are employed. When the cooling roll has a rough periphery surface, the resultant support sheet has a rough surface and exhibits a poor gloss.

In the support sheet, the base paper sheet may be coated on a back surface thereof opposite to the front surface on which the ink receiving layer is formed, with a polyolefin resin coating layer, to enhance the curling resistance of the ink jet recording material.

The cooling roll for the back polyolefin resin coating layer may be the same as that for the front polyolefin resin coating layer or may be a rough surface-finished cooling roll.

The amount of each of the front and back polyolefin resin coating layers is preferably 5 to 50 g/m$^2$, more preferably 10 to 30 g/m$^2$.

Further, the ink jet recording material of the present invention optionally has a back layer comprising the above-mentioned resin having an ink-absorbing property or another resin, and the above-mentioned pigments and additives, to improve the travelling property, blocking resistance and curling resistance of the resultant recording material during printing or storing.

In the ink jet recording material of the present invention, the ink receiving layer and the back layer may be directly coated on the support sheet. However, for the purpose of enhancing the adhesion of those layers to the support sheet, the support sheet surfaces are optionally surface-activated by a corona discharge treatment or flame treatment, or coated with undercoats.

The coloring agent contained in the aqueous ink comprises at least one member selected from, for example, direct dyes, acid dyes, basis dyes, reactive dyes, food dyes, disperse dyes, oil dyed and coloring pigments, of which the conventional dyes and pigments can be used for the present invention without any limitation. The content of the coloring agent in the ink is variable in response to type of liquid medium and properties required for the ink. In the present invention, the ink preferably contains the coloring agent in an amount of 0.1 to 20% by weight which is similar to that of the conventional inks for the ink jet recording.

The liquid medium for the ink preferably comprises water or at least one water-soluble organic solvent. The water-soluble organic solvent is selected from, for example, alkyl alcohols with 1 to 4 carbon atoms, for example, methyl alcohol, ethlyl alcohol, n-propyl alcohol, isopropyl alcohol, n-butyl alcohol and isobutyl alcohol; ketones and ketone alcohols, for example, acetone and diacetone alcohol; polyalkylene glycols, for example, polytheylene glycol and polypropylene glycol; alkylene glycols of which the alkylene group has 2 to 6 carbon atoms, for example, ethlylene glycol, propylene glycol, butylene glycol, triethylene glycol, thiodiglycol, hexylene glycol and diethylene glycol; amide compounds, for example, dimenthylformamide; ether compounds, for example, tetrahydrofuran; and lower alkyl ethers of polyhydric alcohols, for example, glycerol, ethyleneglycol methylether, diethyleneglycolmenthyl (or ethyl) ether, and triethyleneglycolmonomenthylether.

The pigment ink usable for the ink jet recording material of the present invention contains, as a color-forming component, a coloring pigment. In the aqueous pigment ink, the organic and/or inorganic pigment particles are dispersed in water, an aqueous solution or organic solvent solution by using a dispersing agent or other additive.

The organic pigments include, for example, azo pigments, phthalocyanine pigments, berlin pigments, isoindole one pigments, imidazolone pigments, pyranthrone pigments and thioindigo pigments. The inorganic pigments include, for example, carbon black, graphite, synthetic iron oxide yellow, clear red ironoxide, thitanium yellow, molybtate orange, cuprous oxide, cobalt blue and ultramarine.

The dispersing agents for the aqueous pigment ink include, for example, various surfactants, low molecular weight dispersing agents, polymeric dispersing agents having hydrophilic and hydrophobic functional groups.

Usually, the pigment is prepared by mixing the coloring pigment particles and the dispersing agent in a liquid medium; by subjecting the mixture to a pulverizing procedure using a paint shaker or sand mill, to finely pulverize the pigment particles; and by filtering the pulverized particle mixture through a filter having a pore size of 1.0 $\mu$m or less to remove coarse particles.

EXAMPLES

The present invention will be concretely illustrated by the following examples which are merely representative and do not restrict the scope of the present invention in any way. In the examples, "parts" and "%" mean "part by weight" and "% by weight" respectively, unless specifically indicated otherwise. Also, in the examples, the viscosity of the polymeric materials, for example, cellulose derivatives is a viscosity of a 2% aqueous solution of the polymeric material determined by a Brookfield-type viscometer at a temperature of 20° C., unless particularly indicated otherwise. Further, the amounts of coating layers are determined after they are dried, unless particularly indicated otherwise.

Example I-1

An aqueous pulp slurry having a consistency of 0.5% was produced by suspending a mixture of a softwood bleached kraft pulp (NBKP) beaten to a CSF (Canadian Standard Freeness) of 250 ml determined in accordance with Japanese Industrial Standard (JIS) P8121 and a hardwood bleached kraft pulp (LBKP) beaten to a CFS of 280 ml in a mixing weight ratio of 2:8 in an aqueous medium. The aqueous pulp slurry was added with 2% of a cationic starch, 0.4% of an alkyl-ketene dimer, 0.1% of an anionic polyacrylamide resin and 0.7% of a polyamidepolyamine-epichlorohydrin resin, and the resultant slurry was fully agitated to disperse the additives in the slurry.

The resultant pulp slurry was subjected to a paper-forming procedure using a wire paper machine, then passed through a dryer, a sizepress, and a machine calendar, to provide a paper sheet having a basis weight of 128 g/m$^2$, and a bulk density of 1.0 g/cm$^3$. In the above-mentioned sizepress procedure, a sizepress liquid prepared by heat-dissolving a mixture of a carboxyl-modified polyvinyl alcohol with sodium chloride in a mixing weight ratio of 2:1 in water, and having a solid content of 5%, was coated in an amount of 25 ml/m$^2$ on the two surfaces of the dried paper sheet.

The two surfaces of the resultant base paper sheet were subjected to a corona discharge treatment.

Separately, a polyolefin resin composition (I-1) was prepared by mixing the components in the amounts as shown below with a Bunbury's mixer. Also, a polyolefin resin composition (I-2) was prepared in the composition shown below.

| Component | Amount (part) |
|---|---|
| Polyolefin resin composition (I-1) | |
| Long linear low density polyethylene resin (density: 0.926 g/cm$^3$, melt index: 20 g/10 minutes. | 35 |
| Low density polyethylene resin (density: 0.919 g/cm$^3$, melt index: 2 g/10 minutes) | 50 |
| Anatase titanium dioxide (trademark: A-220, made by ISHIHARA SANGYO K.K.) | 15 |
| Zinc stearate | 0.1 |

-continued

| Component | Amount (part) |
|---|---|
| Anti-oxidant (trademark: IRGANOX 1010, made by Ciba-Geigy) | 0.03 |
| Ultramarine (Trademarks: Bluish ultramarine No. 2,000, made by DAIICHI KASEIKOGYO K.K. | 0.09 |
| Fluorescent brightening agent (trademark: UVITEX OB, made by Ciba-Geigy) | 0.3 |
| Polyolefin resin composition (I-2) | |
| High density Polyethylene (density: 0.954 g/cm$^3$, melt index: 20 g/10 minutes) | 65 |
| Low density polyethylene resin (density: 0.924 g/cm$^3$, melt index: 4 g/10 minutes) | 35 |

The polyolefin resin composition (I-1) was coated in a coating amount of 25 g/m$^2$ on the corona discharge-treated felt side surface of the base paper sheet by using a melt-extruder with a T-die at a melt temperature of 320° C., and the surface of the resultant melt layer of the polyolefin resin composition (I-1) was brought into contact with a mirror-finished peripheral surface of a cooling roll to cool and solidify the melt layer. A front polyolefin resin coating layer was formed.

Also, the corona discharge-treated surface of the base paper sheet was coated by the polyolefin resin composition (I-2) in the same manner as that for the polyolefin resin composition (I-1) except that a back polyolefin resin coating layer was formed in an amount of 25 g/m$^2$.

In the polyolefin resin composition (I-1), the antioxidant was employed to prevent the oxidation of the polyolefin resin during the melt-extruding procedure. Also, the ultramarine and fluorescent brightening agent were employed to enhance the apparent whiteness of the front polyolefin resin coating layer and to improve the appearance of the coating layer.

An aqueous coating liquid for an ink receiving layer was prepared by dissolving and dispersing the composition shown below in water and was coated in a dry amount of 15 g/m$^2$ on the front polyolef in resin coating layer by using a die coater and then was dried, to form an ink receiving layer.

An ink jet recording sheet was obtained.

| Ink receiving layer-forming coating liquid Component | Amount (part) |
|---|---|
| Hydroxypropylmethylcellulose (methoxy group-substitution degree: 1.9, 2% solution viscosity: 15 cP, trademark: METHOLOSE 60SH 15, made by SHINETSU KAGAKUKOGYO K.K.) | 100 |
| Cationic resin (monoallylamine chloride salt-diallylamine chloride salt copolymer, (trademark: PAA-D11-HCL, made by NITTO BOSEKI K.K.) | 3 |
| Blocking-preventing agent (amorphous silica with a particle size of about 12 $\mu$m, (trademark: MIZUKASIL P78F, made by MIZUSAWA KAGAKU K.K.) | 1 |

The aqueous coating liquid had a total solid content of the components of 12% and exhibited a viscosity of 4,000 cP.

Example I-2

An ink jet recording sheet was produced by the same procedures as in Example I-1, except that in the coating liquid for the ink receiving layer, the hydroxypropylmethylcellulose was replaced by one with a metoxy group-substitution degree of 1.8, a 2% aqueous solution viscosity of about 50 cP (trademark: METHOLOSE 65SH 50, made by SHINETSU KAGAKUKOGYO K.K.), the total solid content of the components of the coating liquid was changed to 9%, and the ink receiving layer was formed in a dry weight of 12 g/m$^2$.

The coating liquid for the ink receiving layer had a viscosity of 7,000 cP.

Example I-3

An ink jet recording sheet was produced by the same procedures as in Example I-1, except that in the aqueous coating liquid for the ink receiving layer, the hydroxypropylmethylcellulose was replaced by one with a metoxy group-substitution degree of 1.4, a 2% aqueous solution viscosity of about 100 cP (trademark: METHOLOSE 90SH 100, made by SHINETSU KAGAKUKOGYO K.K.), the total component content of the coating liquid was changed to 7%, and the ink receiving layer was formed in a dry weight of 10 g/m$^2$.

The coating liquid for the ink receiving layer had a viscosity of 8,000 cP.

Example I-4

An ink jet recording sheet was produced by the same procedures as in Example I-1, except that in the aqueous coating liquid for the ink receiving layer, the content of the cationic resin was changed to 1.5 parts; the coating procedure was carried out by using a bar coater; the ink receiving layer was formed in a dry weight of 10 g/m$^2$; the total solid content of the components of the coating liquid was 10%; and the viscosity of the coating liquid was 2,000 cP.

Example I-5

An ink jet recording sheet was produced by the same procedures as in Example I-1, except that in the aqueous coating liquid for the ink receiving layer, the content of the cationic resin was changed to 25 parts; the coating procedure was carried out by using a roll coater; and the viscosity of the coating liquid was 4,000 cP.

Example I-6

An ink jet recording sheet was produced by the same procedures as in Example I-1, except that in the aqueous coating liquid for the ink receiving layer, as a cationic resin an epichlorohydric-dimethylamine addition polymerization product (trademark: PAL-2, made by SENKA) was used in an amount of 3 parts; as a blocking-preventing agent, an oxidized starch (trademark: OJI ACE A, made by OJI CORNSTARCH K.K.) was used in an amount of 0.5 part; the coating procedure was carried out by using a blade coater; the total content of the components was 12%; and the viscosity of the coating liquid was 4,000 cP.

Example I-7

An ink jet recording sheet was produced by the same procedures as in Example I-1, except that in the aqueous coating liquid for the ink receiving layer, an urethane resin emulsion (trademark: SUPERFLEX E4500, made by DAIICHI KOGYO SEIYAKU K.K.) was further contained in an amount of 10 parts per 100 parts of the hydroxypropylmethylcellulose; the total content of the components was 12%; and the viscosity of the coating liquid was 3,000 cP.

Example I-8

An ink jet recording sheet was produced by the same procedures as in Example I-1, except that no cationic resin was contained in the aqueous coating liquid for the ink receiving layer; and the aqueous coating liquid had a viscosity of 4,000 cP.

Example I-9

An ink jet recording sheet was produced by the same procedures as in Example I-1, except that the content of the cationic resin in the aqueous coating liquid for the ink receiving layer was changed to 35 parts; and the viscosity of the aqueous coating liquid was 4,000 cP.

Comparative Example I-1

An ink jet recording sheet was produced by the same procedures as in Example I-1, except that in the aqueous coating liquid for the ink receiving layer, the hydroxypropylmethylcellulose was replaced by one having a methoxy group-substitution degree of 1.8 and a viscosity of a 2% aqueous solution thereof of about 400 cP (trademark: METHOLOSE 65SH 400, made by SHINETSU KAGAKUKOGYO K.K.) and the total content of the components was changed to 15%.

The resultant coating liquid gelled, and thus the coating procedure could not be carried out.

Thus, the coating liquid was diluted with water to decrease the total content of the components to 4%. The resultant diluted aqueous coating liquid had a viscosity of 10,000 cP. The diluted coating liquid was coated on the support. The coating could be effected with slight difficulty. The resultant coating layer was uneven. No streaks were formed on the coating layer. The amount of the coating layer was 4 g/m$^2$.

Comparative Example I-2

An ink jet recording sheet was produced by the same procedures as in Example I-1, except that in the aqueous coating liquid for the ink receiving layer, the hydroxypropylmethylcellulose was replaced by one having a methoxy group-substitution degree of 1.4 and a viscosity of a 2% aqueous solution thereof of about 400 cP (trademark: METHOLOSE 90SH 400, made by SHINETSU KAGAKUKOGYO K.K.) and the total content of the components was changed to 15%.

The resultant coating liquid gelled, and thus the coating procedure could not be carried out.

Thus, the coating liquid was diluted with water to decrease the total content of the components to 10%. The resultant diluted aqueous coating liquid was in the state of a gel. When the coating liquid was applied to the support. The resultant coating layer had various coating defects such as poor leveling, and streaks formed from lumps of the gelled coating liquid. The amount of the resultant coating layer was 10 g/m$^2$.

Comparative Example I-3

An ink jet recording sheet was produced by the same procedures as in Example I-1, except that in the aqueous coating liquid for the ink receiving layer, the hydroxypropylmethylcellulose was replaced by carboxymethylcelluslose (trademark: Cellogen 7A, made by DAIICHI KOGYOSEIYAKU K.K. viscosity of 2% aqueous solution thereof: 15 cP); the total content of the components was 12%; and the viscosity of the aqueous coating liquid was 6,000 cP.

Comparative Example I-4

An ink jet recording sheet was produced by the same procedures as in Example I-1, except that in the aqueous coating liquid for the ink receiving layer, the hydroxypropylmethylcellulose was replaced by hydroxyethylcellulose (trademark: HEC-SP400, made by DAICEL K.K., viscosity of 2% aqueous solution thereof: 15 cP); the total content of the components was 12%; and the viscosity of the aqueous coating liquid was 4,000 cP.

Comparative Example I-5

An ink jet recording sheet was produced by the same procedures as in Example I-1, except that in the aqueous coating liquid for the ink receiving layer, the hydroxypropylmethylcellulose was replaced by polyvinylpyrrolidone (trademark: Luviskol K-60, made by BASF, viscosity of 5% aqueous solution thereof: 10 cP); the total content of the components was 12%; and the viscosity of the aqueous coating liquid was 3,500 cP.

Comparative Example I-6

An ink jet recording sheet was produced by the same procedures as in Example I-1, except that in the aqueous coating liquid for the ink receiving layer, the hydroxypropylmethylcellulose was replaced by polyvinyl alcohol (trademark: PVA-117, made by K.K. KURARAY, viscosity of 4% aqueous solution thereof: 5 cP); the total content of the components was 12%; and the viscosity of the aqueous coating liquid was 4,000 cP.

Tests:

In each of the above-mentioned examples and comparative examples, the resultant ink jet recording sheet was subjected to the following ink jet recording aptitude tests.

The ink jet recording sheet was printed with cyan, magenta, yellow-coloring aqueous dye inks by using an ink jet plotter (trademark: NOVAJET, PRO (made by ENCAD CO., GA inks).

[Uniformity of solid-printed ink images]

The uniformity in color density of solid-printed ink images in each color was evaluated by the naked eye observation in the following three classes.

| Class | Uniformity |
|---|---|
| 3 | Substantially no unevenness in color density is found. Good print. |
| 2 | Certain unevenness in color density is found. Usable in practice. |
| 1 | Unevenness is significant. Practical employment is difficult. |

[Ink-drying property]

The printed ink images were rubbed with fingers a certain time after the completion of printing, and the property is evaluated in the following three classes.

| Class | Ink drying property |
|---|---|
| 3 | Ink images are completely dried within 10 minutes after printing. |
| 2 | Ink images are completely dried 10 to 30 minutes after printing. |
| 1 | Ink images are incompletely dried even 30 minutes after printing. |

[Gloss of ink images]

The gloss at 75 degree angle of solid-printed red-colored images (magenta ink+yellow ink) is measured in accordance with JIS P 8142.

[Water resistance of ink images]

The printed ink image portion of the recording sheet was immersed in water for 10 seconds and then dried in the ambient atmosphere.

The blotting of the ink around the ink images was evaluated in the following five classes.

| Class | Ink blotting |
|---|---|
| 5 | No blotting of the ink is found |
| 4 | Slight blotting of the ink is found. The ink images are fully kept in the original condition. |
| 3 | Certain blotting of the ink is found. The ink images are substantially kept in the original condition. |
| 2 | The ink images are spread, but retained on the recording sheet. |
| 1 | The ink is substantially disappeared. No images are retained. |

[Tackiness of printed ink images in high humidity atmosphere]

The printed recording sheet was left to stand in an atmosphere with a temperature of 30° C. and a relative humidity of 80% for 24 hours. The tackiness of the printed ink images is evaluated by touching with the fingers into the following three classes.

| Class | Tackiness |
|---|---|
| 3 | No tackiness is felt |
| 2 | A certain tackiness is felt |
| 1 | A strong tackiness is felt |

[Appearance of ink receiving layer surface]

The appearance of the ink receiving layer surface was evaluated by the naked eye observation into the following three classes.

The results of the tests are shown in Table 1.

| Class | Appearance |
|---|---|
| 3 | No coating unevenness and no streaks are found. Appearance and gloss of non-printed portions are excellent. |
| 2 | Certain coating unevenness is found and gloss of non-printed portions is good. Usable in practice |
| 1 | Significant coating defects, such as coating unevenness, ink gaps, ink repellings, spots, steaks, and coating patterns are found. |

TABLE 1

| Example No. | | Uniformity of ink images | Ink drying property | Gloss (%) | Water resistance of ink images | Tackiness | Appearance of ink receiving layer |
|---|---|---|---|---|---|---|---|
| Example | I-1 | 3 | 3 | 91 | 4 | 3 | 3 |
| | I-2 | 3 | 3 | 90 | 4 | 3 | 3 |
| | I-3 | 3 | 3 | 86 | 4 | 3 | 3 |
| | I-4 | 3 | 3 | 88 | 4 | 3 | 2 |
| | I-5 | 3 | 2 | 86 | 5 | 3 | 2 |
| | I-6 | 3 | 3 | 89 | 4 | 3 | 2 |
| | I-7 | 3 | 3 | 87 | 5 | 3 | 3 |
| | I-8 | 3 | 3 | 91 | 3 | 3 | 3 |
| | I-9 | 3 | 2 | 88 | 4 | 3 | 3 |
| Comparative Example | I-1 | 1 | 1 | 80 | 1 | 3 | 3 |
| | I-2 | 2 | 3 | 65 | 5 | 3 | 1 |
| | I-3 | 1 | 2 | 85 | 5 | 3 | 3 |
| | I-4 | 1 | 2 | 87 | 5 | 3 | 3 |
| | I-5 | 3 | 1 | 91 | 5 | 1 | 3 |
| | I-6 | 1 | 1 | 88 | 5 | 2 | 3 |

As table 1 clearly shows, in Comparative Example I-1 wherein a conventional hydroxypropylmethylcellulose having a high viscosity was used, the coating with a low concentration coating liquid resulted in an unsufficient amount of the resultant coating layer. In Comparative Example I-2 in which a high viscosity coating liquid having a poor coating property was used, the ink images formed on the resultant ink receiving layer exhibited an unsatisfactory image quality. Compared with them, in Examples I-1 to I-9 in which hydroxypropylmethylcellulose having a 2% aqueous solution viscosity of 200 cP or less was used, all of the test results were good. Also, when a cation resin is used in an amount of 1 to 30 parts together with 100 parts of hydroxypropylmethylcellulose, the ink images formed on the resultant ink receiving layer exhibited excellent water resistance and other test results were good. Particularly, in Examples I-1 to I-3 and I-7 to I-9 wherein the coating procedure was carried out by using a die coater, the resultant ink receiving layer exhibited good surface appearance, and the gloss of the printed ink images was enhanced. In Comparative Examples I-3 to I-6, a water-soluble resin other than hydroxypropylmethylcellulose was used. In Comparative Examples I-3, I-4 and I-6, the gloss of the printed ink images and the ink absorption were low and thus the image quality was unsatisfactory.

In Comparative Example I-5, while the image quality and gloss of the ink images were good, the ink drying property was bad, and thus the resultant ink jet recording sheet could not be employed in practice.

Example II-1

A pulp slurry having a pulp content of 0.5% was prepared from a mixture of a softwood bleached kraft pulp (NBKP) having a Canadian Standard Freeness (CSF, JIS P8121) of 250 ml with a hardwood bleached kraft pulp (LBKP) in a mixing weight ratio of 2:8.

To the pulp slurry, the additives for paper-forming in the amounts based on the bone-dry weight of the pulp mixture, as shown below were added, and the resultant slurry was fully agitated

| | |
|---|---|
| Cationic starch | 2.0% |
| Alkylketene dimer | 0.4% |
| Anionic polyacrylamide resin | 0.1% |
| Polyamidepolyamine-epichlorohydrin resin | 0.7% |

The above-mentioned pulp slurry was subjected to a wire paper machine, and passed through a dryer, a sizepress procedure and a machine calendar. The resultant paper sheet for a base sheet of support had a basis weight of 128 g/m$^2$ and a bulk density of 1.0 g/cm$^3$. The sizepress liquid used in the sizepress procedure was prepared by mixing a carboxyl-modified polyvinyl alcohol with sodium chloride in a mixing weight ratio of 2:1, the mixture was heat-dissolved in water. The sizepress liquid has a solid content of 5%. The sizepress liquid was coated in an amount of 25 ml/m$^2$ on the two surfaces of the base paper sheet.

The two surfaces of the base sheet was subjected to a corona discharge treatment. Separately a polyolefin resin composition (II-1) for a front polyolefin resin coating layer and a polyolefin resin composition (II-2) for a back polyolefin resin coating layer were prepared in the compositions shown below, by mixing the components in a Bunbury's mixer.

Polyolefin resin composition (II-1)

| Component | Amount (part) |
|---|---|
| Long linear low density polyethylene resin (density: 0.926 g/cm$^3$, melt index: 2 g/10 minutes) | 35 |

-continued

| Component | Amount (part) |
|---|---|
| Low density polyethylene resin (density: 0.919 g/cm$^3$, melt index: 2 g/10 minutes) | 50 |
| Anatase titanium dioxide (trademark: A-220, made by ISHIHARA SANGYO K.K.) | 15 |
| Zinc stearate | 0.1 |
| Antioxidant (trademark: Irganox 1010, made by Ciba-Geigy) | 0.03 |
| Ultramarine (Trademark: Bluish Ultramarine NO. 2000, made by Daiichi Kasei K.K. | 0.09 |
| Fluorescent brightening agent (trademark: UVITEX OB, made by Ciba-Geigy) | 0.3 |
| Polyolefin resin composition (II-2) | |
| High density polyethylene resin (density: 0.954 g/cm$^3$, melt index: 20 g/10 minutes) | 65 |
| Low density polyethylene resin (density: 0.924 g/cm$^3$, melt index: 4 g/10 minutes) | 35 |

The polyolefin resin composition (II-1) was extrusion-coated in an amount of 25 g/m$^2$ at a melt temperature of 320° C. on the front surface (felt side surface) of the base sheet, and the polyolefin resin composition (II-2) was melt-coated in an amount of 25 g/m$^2$ at a temperature of melt temperature of 320° C. on the back surface (wire side surface) of the base sheet, each through a T-die. Each coated polyolefin resin melt layer was brought into contact with a mirror-finished peripheral surface of a cooling roll to cool and solidify the polyolefin resin melt layer, to prepare a support.

In the above-mentioned polyolefin resin composition (II-1) for the front polyolefin resin coating layer, the antioxidant was used for the purpose of preventing the oxidation of the polyethylene resins during the extrusion-coating procedure. Also, the ultramarine and the fluorescent brightening agent were employed to import a bluish color tone to and to improve the apparent whiteness of the ink receiving layer, and to improve the appearance of the ink receiving layer by the naked eye. Separately, an aqueous coating liquid for the ink receiving layer was prepared in a solid content of 10% and in the following composition.

| Component | Amount (part) |
|---|---|
| Hydroxypropylmethylcellulose having a 2% aqueous solution viscosity of 50 cP, an average methoxy group substitution degree of 1.9, an average hydroxypropoxy group-substitution degree of 0.25 (trademark: METHOLOSE 60SH-50, made by SHINETSU KAGAKUKOGYO K.K.) | 95 |
| Polyvinyl pyrrolidone having a weight average molecular weight of 9,000 (trademark: Luviskol K-17, made by BASF) | 5 |
| Blocking-preventing agent (starch particles having a particle size of 10 to 20 $\mu$m, trademark: ACE A, made by OJI CORNSTARCH K.K.) | 0.2 |

The aqueous coating liquid was coated on the surface of the front polyolefin resin coating layer by using a die coater and then was dried, to form an ink receiving layer with a dry weight of 15 g/m$^2$.

An ink jet recording sheet was obtained.

Example II-2

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group substitution degree of 1.9, an average hydroxypropoxy group-substitution degree of 0.25 (trademark: METHOLOSE 60 SH-50, made by SHINETSU KAGAKUKOGYO K.K.) | 80 |
| Polyvinyl pyrrolidone having a weight average molecular weight of 9,000 (trademark: Luviskol K-17, made by BASF) | 20 |
| Blocking-preventing agent (starch particles having a particle size of 10 to 20 $\mu$m, trademark: ACE A, made by OJI CORNSTARCH K.K.) | 0.2 |

Example II-3

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group-substitution degree of 1.9, an average hydroxypropoxy group-substitution degree of 0.25 (trademark: METHOLOSE 60 SH-50, made by SHINETSU KAGAKUKOGYO K.K.) | 60 |
| Polyvinyl pyrrolidone having a weight average molecular weight of 9,000 (trademark: Luviskol K-17, made by BASF) | 40 |
| Blocking-preventing agent (starch particles having a particle size of 10 to 20 $\mu$m, trademark: ACE A, made by OJI CORNSTARCH K.K.) | 0.2 |

Example II-4

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group substitution degree of 1.9, an average hydroxypropoxy group-substitution degree of 0.25, (trademark: METHOLOSE 60 SH-50, made by SHINETSU KAGAKUKOGYO K.K.) | 50 |
| Polyvinyl pyrrolydone having a weight average molecular weight of 9,000, (trademark: Luviskol K-17, made by BASF) | 50 |
| Blocking-preventing agent (starch particles having a particle size of 10 to 20 $\mu$m, trademark: ACE A, made by OJI CORNSTARCH K.K.) | 0.2 |

Example II-5

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group-substitution degree of 1.9, an average hydroxypropoxy group-substitution degree of 0.25 (trademark: METHOLOSE 60 SH-50, made by SHINETSU KAGAKUKOGYO K.K.) | 30 |
| Polyvinyl pyrrolidone having a weight average molecular weight of 9,000 (trademark: Luviskol K-17, made by BASF) | 70 |
| Blocking-preventing agent (starch particles having a particle size of 10 to 20 $\mu$m, trademark: ACE A, made by OJI CORNSTARCH K.K.) | 0.2 |

Example II-6

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 100 cP, an average methoxy group- | 60 |

-continued

Aqueous coating liquid for ink receiving layer

| Component | Amount (part) |
|---|---|
| substitution degree of 1.4, an average hydroxypropoxy group-substitution degree of 0.20 (trademark: METHOLOSE 90 SH-100, made by SHINETSU KAGAKUKOGYO K.K.) | |
| Polyvinyl pyrrolidone having a weight average molecular weight of 9,000 (trademark: Luviskol K-17, made by BASF) | 40 |
| Blocking-preventing agent (starch particles having a particle size of 10 to 20 μm, trademark: ACE A, made by OJI CORNSTARCH K.K.) | 0.2 |

Example II-7

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group-substitution degree of 1.8, an average hydroxypropoxy group-substitution degree of 0.15 (trademark: METHOLOSE 65 SH-50, made by SHINETSU KAGAKUKOGYO K.K.) | 60 |
| Polyvinyl pyrrolidone having a weight average molecular weight of 45,000 (trademark: Luviskol K-30, made by BASF) | 40 |
| Blocking-preventing agent (starch particles having a particle size of 10 to 20 μm, trademark: ACE A, made by OJI CORNSTARCH K.K.) | 0.2 |

Example II-8

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group-substitution degree of 1.8, an average hydroxypropoxy group-substitution degree of 0.15 (trademark: METHOLOSE | 60 |

-continued

Aqueous coating liquid for ink receiving layer

| Component | Amount (part) |
|---|---|
| 65 SH-50, made by SHINETSU KAGAKUKOGYO K.K.) | |
| Polyvinyl pyrrolydone having a weight average molecular weight of 9,000, (trademark: Luviskol K-17, made by BASF) | 40 |
| Blocking-preventing agent (starch particles having a particle size of 10 to 20 μm, trademark: ACE A, made by OJI CORNSTARCH K.K.) | 0.2 |

Example II-9

An ink jet recording sheet was produced by the same procedures as in Example II-3, except that the same aqueous coating liquid as in Example II-3, was coated on a surface of a polyethylene terephthalate (PET) film having a thickness of 100 μm (trademark: MERINEX D535, made by ICI) by using a die coater, and dried to form an ink receiving layer in a dry weight of 15 g/m$^2$.

Example II-10

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

Aqueous coating liquid for ink receiving layer

| Component | Amount (part) |
|---|---|
| Hydroxypropylmethylcellulose having a 2% aqueous solution viscosity of 50 cP, an average methoxy group-substitution degree of 1.8, an average hydroxypropoxy group-substitution degree of 0.15 (trademark: METHOLOSE 65 SH-50, made by SHINETSU KAGAKUKOGYO K.K.) | 100 |
| Blocking-preventing agent (starch particles having a particle size of 10 to 20 μm, trademark: ACE A, made by OJI CORNSTARCH K.K.) | 0.2 |

Comparative Example II-1

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Polyvinyl pyrrolidone having a weight average molecular weight of 9,000 (trademark: Luviskol K-17, made by BASF) | 100 |
| Blocking-preventing agent (starch particles having a particle size of 10 to 20 μm, trademark: ACE A, made by OJI CORNSTARCH K.K.) | 0.2 |

Comparative Example II-2

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Polyvinyl pyrrolidone having a weight average molecular weight of 1,200,000 (trademark: Luviskol K-90, made by BASF) | 100 |
| Blocking-preventing agent (starch particles having a particle size of 10 to 20 μm, trademark: ACE A, made by OJI CORNSTARCH K.K.) | 0.2 |

Comparative Example II-3

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Polyvinyl alcohol (trademark: PVA 420, made by KURARAY) | 100 |
| Blocking-preventing agent (starch particles having a particle size of 10 to 20 μm, trademark: ACE A, made by OJI CORNSTARCH K.K.) | 0.2 |

Comparative Example II-4

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Hydroxypropylcellulose (trademark: HPC-M, made by NIPPON SODA K.K.) | 100 |
| Blocking-preventing agent (starch particles having a particle size of 10 to 20 μm, trademark: ACE A, made by OJI CORNSTARCH K.K.) | 0.2 |

Comparative Example II-5

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Carboxymethylcellulose (trademark: CELOGEN-7A, made by DAIICHI KOGYOSEIYAKU K.K.) | 100 |
| Blocking-preventing agent (starch particles having a particle size of 10 to 20 μm, trademark: ACE A, made by OJI CORNSTARCH K.K.) | 0.2 |

Comparative Example II-6

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Hydroxyethylcellulose (trademark: HEC-SP400, made by DAICEL K.K.) | 100 |
| Blocking-preventing agent (starch particles having a particle size of 10 to 20 μm, trademark: ACE A, made by OJI CORNSTARCH K.K.) | 0.2 |

Example II-11

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/m$^2$.

| Aqueous coating liquid for ink receiving layer | |
|---|---|
| Component | Amount (part) |
| Hydroxypropylmethylcellulose having a 2% aqueous solution viscosity of 15 cP, an average methoxy group-substitution degree of 1.9, and average hydroxypropoxy group-substitution degree of 0.25 (trademark: METHOLOSE 60 SH-15, made by SHINETSU KAGAKUKOGYO K.K.) | 100 |
| Blocking-preventing agent (starch particles having a particle size of 10 to 20 μm, trademark: ACE A, made by OJI CORNSTARCH K.K.) | 0.2 |

Example II-12

An ink jet recording sheet was produced by the same procedures as in Example II-1, except that the same support sheet as in Example II-1 was coated with an aqueous coating liquid having the composition as shown below by using a die coater and was dried to form an ink receiving layer having a dry weight of 15 g/Im$^2$.

| Aqueous coating liquid for ink receiving layer | |
|---|---|
| Component | Amount (part) |
| Hydroxypropylmethylcellulose having a 2% aqueous solution viscosity of 50 cP, an average methoxy group-substitution degree of 1.9, an average hydroxypropoxy group-substitution degree of 0.25 (trademark: METHOLOSE 60 SH-50, made by SHINETSU KAGAKUKOGYO K.K.) | 60 |
| Polyvinyl pyrrolidone having a weight average molecular weight of 450,000 (trademark: Luviskol K-60S, made by BASF) | 40 |
| Blocking-preventing agent (starch particles having a particle size of 10 to 20 μm, trademark: ACE A, made by OJI CORNSTARCH K.K.) | 0.2 |

Tests:

In each of Examples II-1 to II-12 and Comparative Examples II-1 to II-6, the resultant ink jet recording sheet was subjected to the following tests for the ink jet recording aptitude.

The ink jet recording sheet was printed with aqueous dye inks or aqueous pigment inks by using an ink jet plotter (trademark: NOVAJET PRO (made by ENCAD CO., GA aqueous dye inks, GO aqueous pigment inks).

[Uniformity of solid-printed ink images]

The uniformity in color density of solid-printed ink images and the blotting of the ink in the boundaries of the ink images in each color was evaluated by the naked eye observation in the following five classes.

| Class | Image quality |
|---|---|
| 5 | Substantially no unevenness in color density no blottings of the ink, and no crackings of the ink images (formed from aqueous pigment ink) are found. Excellent for use in practice. |
| 4 | Slight unevenness in color density, slight blotting of the ink and/or slight cracking of the ink images (formed from an aqueous pigment ink) are found. Good for use in practice. |
| 3 | Certain unevenness in color density, certain blotting of the ink and/or certain cracking of the ink images (formed from an aqueous pigment ink) are found. |
| 2 | Unevenness in color density, blotting of the ink and/or cracking of the ink images (formed from an aqueous pigment ink) are found. Difficult to use in practice. |
| 1 | Significant blotting of the ink and cracking of ink images (formed from an aqueous pigment ink) occur. Useless in practice. |

[Ink drying property]

The printed ink images were rubbed with fingers a certain time after the completion of printing, and the ink drying property is evaluated in the following four classes.

| Class | Ink drying property |
|---|---|
| 4 | Ink images are completely dried 20 minutes or less after printing. |
| 3 | Ink images are completely dried 20 minutes or more but less than 40 minutes after printing. |
| 2 | Ink images are completely dried 40 minutes or more but less than 60 minutes after printing. |
| 1 | Ink images are incompletely dried even 60 minutes after printing. |

[Clarity of ink images]

The clarity of the ink images were evaluated by the naked eye to the following four classes.

| Class | Clarity |
|---|---|
| 4 | Color density, gloss and clarity of ink images are excellent |
| 3 | Color density and gloss of ink images are good |
| 2 | Color density, gloss of ink images and clarity are slightly low |
| 1 | Color density, gloss and clarity of ink images are unsatisfactory. Difficult to use in practice. |

[Color density of ink images]

Ink images were printed on the ink jet recording sheet with black-colored images and blue-colored images (Cyan-colored ink+magenta-colored ink) and the ink densities of the ink images were measured by a Macbeth color density meter (model RD914). In Table 2, the cyan color density was measured through a cyan-colored filter.

[Gloss of ink images]

The glosses at a 75 degree angle of solid printed black and blue colored images were measured in accordance with JIS P 8142.

[Gloss of sheet]

The gloss at a 75 degree angle of a non-printed portion of the ink jet recording sheet was measured in accordance with JIS P8142.

[Haze (Conding degree)]

The haze of the ink jet recording sheet was measured by using a light reflection and transmission meter (model: HR-100, made by MURAKAMI SHIKISAI GIJUTSU KENKYUSHO).

The test results are shown in Table 2.

TABLE 2

| | | Item | | | | | | | | | | | | |
|---|---|---|---|---|---|---|---|---|---|---|---|---|---|---|
| | | | | | GO aqueous pigment ink images | | | | | | | | | |
| | | | | | | | | Color density | | | | | | |
| | | GA aqueous dye ink images | | | | | | Solid | | | | | | |
| | | | Ink | Clarity | | Ink | Clarity | black- | Solid blue- | | | | White sheet | |
| | | Uniformity | drying | of | Uniformity | drying | of | colored | colored images | | Gloss | | Gloss | Haze |
| Example No. | | of images | property | images | of images | property | images | images | Cyan | Magenta | Black | Blue | (%) | (%) |
| Example | II-1 | 5 | 4 | 4 | 5 | 4 | 3 | 2.37 | 1.44 | 1.68 | 100 | 76 | 91 | — |
| | II-2 | 5 | 4 | 4 | 5 | 4 | 4 | 2.44 | 1.54 | 1.80 | 100 | 83 | 92 | — |
| | II-3 | 5 | 4 | 4 | 5 | 4 | 4 | 2.62 | 1.67 | 1.96 | 100 | 88 | 90 | — |
| | II-4 | 5 | 4 | 4 | 5 | 4 | 4 | 2.68 | 1.75 | 2.08 | 100 | 85 | 91 | — |
| | II-5 | 4 | 3 | 4 | 4 | 3 | 4 | 2.70 | 1.80 | 2.12 | 100 | 80 | 91 | — |
| | II-6 | 5 | 4 | 3 | 5 | 4 | 3 | 2.32 | 1.41 | 1.65 | 100 | 75 | 80 | — |
| | II-7 | 5 | 4 | 4 | 5 | 4 | 4 | 2.41 | 1.66 | 1.92 | 100 | 87 | 88 | — |
| | II-8 | 5 | 4 | 4 | 5 | 4 | 4 | 2.64 | 1.66 | 1.98 | 100 | 92 | 90 | — |
| | II-9 | 5 | 4 | 4 | 5 | 4 | 4 | 2.65 | 1.56 | 1.85 | — | — | — | 5.0 |
| | II-10 | 5 | 4 | 4 | 5 | 4 | 2 | 2.28 | 1.38 | 1.60 | 100 | 70 | 92 | — |
| Comparative Example | II-1 | 2 | 1 | — | 1 | 1 | — | — | — | — | — | — | 92 | — |
| | II-2 | 4 | 1 | 4 | 2 | 1 | 1 | 1.23 | 1.23 | 1.38 | 91 | 65 | 93 | — |
| | II-3 | 2 | 2 | 2 | 2 | 2 | 1 | 1.19 | 1.14 | 1.28 | 83 | 79 | 90 | — |
| | II-4 | 2 | 1 | 2 | 2 | 1 | 1 | 1.62 | 1.27 | 1.33 | 90 | 62 | 94 | — |
| | II-5 | 3 | 3 | 4 | 5 | 3 | 1 | 1.89 | 1.13 | 1.42 | 93 | 68 | 93 | — |
| | II-6 | 2 | 1 | — | 1 | 1 | — | — | — | — | — | — | 90 | — |
| | II-11 | 5 | 4 | 4 | 2 | 4 | 1 | 2.00 | 1.15 | 1.39 | 98 | 80 | 91 | — |
| | II-12 | 5 | 4 | 4 | 4 | 4 | 2 | 2.03 | 1.41 | 1.54 | 92 | 70 | 65 | — |

Note for Table 2

In Example II-9 in which a transparent ink jet recording sheet was produced, the color density of the printed images were carried out in such a manner that the printed recording sheet was placed on the support sheet used in Example II-1, and then the color density of the printed images was measured.

As Table 2 clearly shows, in Example II-10 wherein the ink receiving layer substantially consisted of the HPMC alone and was free from the polyvinyl pyrrolidone, the uniformity of the ink images, the ink-drying property, the color density of the ink images and the gloss of the ink images were better than those in the comparative examples, and they were well-balanced. However, when the test results of Example II-10 were compared with those of the other examples wherein the polyvinyl pyrrolidone was contained in the ink receiving layers, the color densities and gloss of the aqueous pigment ink images were slightly lower than those of the other examples. The ink receiving layer of Example II-5 exhibited a slightly low ink drying property and a high blotting of the aqueous dye ink. Also, in Example II-6 in which a HPMC having a low average methoxy group-substitution degree of 1.4 was used, the transparency of the ink receiving layer was slightly low, and thus the gloss of the non-printed ink jet recording sheet was lightly low. Therefore, when the images were formed from the aqueous pigment ink, the color density and the gloss of the pigment ink images of Example II-6 were not greatly better than those of Example II-10.

In Comparative Example II-1 and Comparative Example II-6, the blotting of the ink and the cracking of the ink images occurred often, and thus the color density and the gloss of the ink images were not measured.

In each of Comparative Example II-2 to Comparative Example II-6, a water-soluble resin other than the HPMC was contained in place of HPMC in the ink receiving layer, the tested properties were more unsatisfactory than those in the examples.

In Example II-11 in which a HPMC having a low viscosity, the images formed from the aqueous dye ink exhibited excellent properties. However, the resistance to the cracking of the images formed from the aqueous pigment ink was slightly low, and the color density and gloss of the pigment ink images were lower than those in Examples II-1 to II-10. Therefore, for the ink jet recording sheet of Example II-11, the use of the conventional aqueous dye ink is recommended.

In Example II-12 wherein a polyvinyl pyrrolidone having a high molecular weight was contained together with the HPMC in the ink receiving layer, the resultant ink receiving layer exhibited a slightly lower transparency, and a slightly lower color density and gloss of the ink images than those of Examples II-1 to II-9.

The present invention can provide an ink jet recording material having excellent image gloss and ink blotting resistance and no or very low tackiness.

In the ink jet recording material of the present invention, the ink receiving layer exhibits a high transparency, high resistances to cracking and to blotting of the ink images, particularly the aqueous pigment ink images. Also, the ink images printed on the ink receiving layer of the present invention have a high evenness, excellent color density, gloss and water resistance.

Further, the ink receiving layer of the present invention exhibits a substantially no tackiness and a satisfactory ink drying property.

Example III-1

A softwood bleached kraft pulp (NBKP) having a Canadian Standard Freeness (CSF, JIS P8121) of 250 ml and a hardwood bleached kraft pulp (LBKP) having a CSF of 280 ml were mixed in a mixing weight ratio of 2:8 with each other, and were suspended in water to provide a pulp slurry having a pulp consistency of 0.5%. Into the pulp slurry, 2.0% of a cationic starch, 0.4% of an alkylketene dimer, 0.1% of an anionic polyacrylamide resin and 0.7% of a polyamidepolyamine-epichlorohydrin resin, each based on the bone dry weight of the pulp mixture, were mixed, and the mixed pulp slurry was fully agitated to disperse the mixed components in the slurry.

The pulp slurry was subjected to a paper process using a wire paper-forming machine and then passed through a dryer, a sizepress procedure and a machine calendar, to produce a paper sheet having a basis weight of 128 g/m$^2$ and a bulk density of 1.0 g/cm$^3$. The sizepress liquid used in the sizepress procedure was prepared by mixing a carboxyl-modified polyvinyl alcohol with sodium chloride in a mixing weight ratio of 2:1, the resultant mixture was heat-dissolved in water to prepare an aqueous solution having a total content of 5%. The sizepress liquid was coated in an amount of 25 ml/m$^2$ on the two surfaces of the dried paper sheet.

A corona discharge treatment was applied to the two surfaces of the paper sheet; a polyolefine resin component (III-1) having the composition as shown below was coated in an amount of 25 g/m$^2$ on the felt-side surface (the front surface) of the paper sheet by a melt-extruder with a T-die at a melt temperature of 320° C., and a polyolefin resin composition (III-2) having the composition as shown below was coated in an amount of 25 g/m$^2$ on the wire-side surface (the back surface) of the paper sheet, by the same procedure as that for the resin composition (III-1).

The coated polyolefin resin composition layers were respectively brought into contact with cooling rolls each having a mirror-finished periphery surface and solidified. A support sheet was obtained.

Polyolefin Resin Composition (III-1)

| Component | Amount (part) |
|---|---|
| Long linear low density polyethylene resin (density: 0.926 g/cm$^3$, melt index: 20 g/10 minutes) | 35 |
| Low density polyethylene resin (density: 0.919 g/cm$^3$, melt index: 2 g/10 minutes) | 50 |
| Anatase titanium dioxide (trademark: A-220, made by ISHIHARA SANGYO K.K.) | 15 |
| Zinc stearate | 0.1 |
| Antioxidant (trademark: IRGANOX 1010, made by Ciba-Geigy) | 0.03 |
| Ultramarine (trademark: BLUEISH ULTRAMARINE No. 2000, made by DAIICHI KASEI K.K.) | 0.09 |
| Fluorescent brightening agent | 0.3 |

-continued

| Component | Amount (part) |
|---|---|
| (trademark: UVITEX OB, made by Ciba-Geigy) | |

Polyolefin resin composition (III-2)

| Component | Amount (part) |
|---|---|
| High density polyethylene resin (density: 0.954 g/cm$^3$, melt index: 20 g/10 minutes) | 65 |
| Low density polyolefin resin (density: 0.924 g/cm$^3$, melt index: 4 g/10 minutes) | 35 |

In the polyolefin resin composition (III-1), the antioxidant was used for the purpose of preventing the oxidation of the polyethylene resins during the melt-extrusion coating procedure. Also, the ultramarine and the fluorescent brightening agent was used to import an apparent bluish white color to the polyolefine resin composition (III-1) layer and to improve the apparent whiteness of the layer.

An aqueous coating liquid for an ink receiving layer was prepared in the following composition.

Coating liquid for ink receiving layer

| Component | Amount (part) |
|---|---|
| (A) Hydroxypropylmethylcellulose (trademark: METHOLOSE 60 SH 15, made by SHINETSU KAGAKUKOGYO K.K., a 2% aqueous solution viscosity: 15 cP) | 100 |
| (B) Vinyl pyrrolidon-vinyl acetate copolymer having an weight average molecular weight of 45,000 (trademark: PVP/VA S-630, made by ISP) | 30 |
| (C) Polyalkylenepolyamine-dicyandiamide condensation product (trademark: AMIGEN NF, made by DAIICHI KOGYOSEIYAKU, K.K.) | 3 |
| (D) Allylamine-diallylamine copolymer (trademark: PAA-D11, made by NITTO BOSEKI K.K.) | 2 |
| Blocking-preventing agent (amorphous silica, trademark: FINESIL X-45, made by TOKUYAMA K.K.) | 1 |

The aqueous coating liquid had a total solid content of the components of 12%.

The aqueous coating liquid was coated on the polyolefine resin composition (III-1)-coated surface of the support sheet by using a die coater, and then dried, to form an ink receiving layer in a dry weight of 15 g/m$^2$.

Example III-2

An ink jet recording sheet was produced by the same procedures as in Example III-1, except that in the aqueous coating liquid for the ink receiving layer, the vinyl pyrrolidone-vinyl acetate copolymer (PVP/VA S-630) was replaced by a polyvinyl pyrrolidone having a weight average molecular weight of 60,000 (trademark: PVP K-30, made by ISP), and the support sheet consisted of a white-colored polyester film having a thickness of 125 $\mu$m (trademark: CRYSPER G2323, made by TOYOBO K.K.)

Example III-3

An ink jet recording sheet was produced by the same procedures as in Example III-1, except that in the aqueous coating liquid for the ink receiving layer, the vinyl pyrrolidone-vinyl acetate copolymer (PVP/VA S-630) was replaced by a polyvinyl pyrrolidone having a weight average molecular weight of 1,200,000 (trademark: PVP K-120, made by ISP).

Example III-4

An ink jet recording sheet was produced by the same procedures as in Example III-1, except that in the aqueous coating liquid for the ink receiving layer, the vinyl pyrrolidone-vinyl acetate copolymer (PVP/VA S-630) was replaced by an alkylated polyvinyl pyrrolidone having a weight average molecular weight of 66,000 (trademark: ANTARON P-904, made by ISP).

Example III-5

An ink jet recording sheet was produced by the same procedures as in Example III-1, except that in the aqueous coating liquid for the ink receiving layer, the vinyl pyrrolidone-vinyl acetate copolymer (PVP/VA S-630) was employed in an amount of 7 parts.

Example III-6

An ink jet recording sheet was produced by the same procedures as in Example III-1, except that in the aqueous coating liquid for the ink receiving layer, the vinyl pyrrolidone-vinyl acetate copolymer (PVP/VA S-630) was employed in an amount of 85 parts.

Example III-7

An ink jet recording sheet was produced by the same procedures as in Example III-1, except that in the aqueous coating liquid for the ink receiving layer, the polyalkylenepolyamine-dicyandiamide condensation product (AMIGEN NF) was employed as a cationic resin in an amount of 1.0 part, and the allylamine-diallylamine copolymer (PAA-D11) was used in an amount of 0.5 part.

Example III-8

An ink jet recording sheet was produced by the same procedures as in Example III-1, except that in the aqueous coating liquid for the ink receiving layer, the polyalkylenepolyamine-dicyandiamide condensation product (AMIGEN NF) was employed as a cationic resin in an amount of 12 parts, and the allylamine-diallylamine copolymer (PAA-D11) was used in an amount of 6 parts.

Example III-9

An ink jet recording sheet was produced by the same procedures as in Example III-1, except that as a support sheet, a synthetic paper sheet having a thickness of 110 $\mu$m (trademark: YUPO FPG-110, made by OJI YUKA-GOSEISHI K.K.) comprising a polypropylene resin and an inorganic pigment and a three-layered structure composed of a core-base layer and paper-like front and back layers, was used.

Comparative Example III-1

An ink jet recording sheet was produced by the same procedures as in Example III-1, except that in the aqueous coating liquid for the ink receiving layer, the HPMC (METHOLOSE 60 SH 15) was replaced by a hydroxyethylcellulose (trademark: SP 200, made by DAICEL K.K.).

Example III-10

An ink jet recording sheet was produced by the same procedures as in Example III-1, except that in the aqueous coating liquid for the ink receiving layer, the vinyl pyrrolidone-vinyl acetate copolymer (PVP/VA S-630) was employed in an amount of 2 parts.

Example III-11

An ink jet recording sheet was produced by the same procedures as in Example III-1 with the following exceptions.

In the preparation of the coating liquid for the ink receiving layer, the hydroxypropylmethylcellulose (METHOLOSE 60SH15) was replaced by 100 parts of a hydroxypropylmethylcellulose (trademark: METHOLOSE 60SH50, made by SHINETSU KAGAKUKOGYO K.K, 2% aqueous solution viscosity: 50 cP), and the vinyl pyrrolidone-vinyl acetate copolymer (PVP/VAS-630) was replaced by 30 parts of polyvinylpyrrolidone (trademark: PVPK15, weight average molecular weight: 10,000, made by ISP).

Tests:

Examples III-1 to III-11 and Comparative Example III-1, the resultant ink jet recording sheet was subjected to the following ink jet recording aptitude tests.

The ink jet recording sheet was printed with cyan, magenta, yellow-coloring aqueous dye inks by using an ink jet plotter (trademark: NOVAJET PRO (made by ENCAD CO., GA aqueous dye inks).

[Blotting resistance of ink images]

The uniformity in color density of the solid printed ink images in each color was evaluated by the naked eye observation in the following three classes.

| Class | Uniformity |
|---|---|
| 3 | Substantially no ink-blotting is found. Good print. |
| 2 | Certain ink-blotting is found. Usable in practice. |
| 1 | Ink-blotting is significant. Practical employment is difficult. |

[Gloss of ink images]

The gloss at 75 degree angle of solid-printed green-colored images formed from a yellow-coloring ink and a cyan-coloring ink is measured in accordance with JIS P 8142.

[Non-tackiness of printed ink images in high humidity atmosphere]

The printed recording sheet was left to stand in an atmosphere with a temperature of 35° C. and a relative humidity of 80% for 24 hours. The tackiness of the printed ink images is evaluated by touching with the fingers into the following three classes.

| Class | Tackiness |
|---|---|
| 3 | No tackiness is felt |
| 2 | A certain tackiness is felt |
| 1 | A strong tackiness is felt. Practical employment is difficult. |

[Ink-drying property]

The printed ink images were sulked with fingers a certain time after the completion of printing, and the ink drying property is evaluated in the following three classes.

| Class | Ink drying Property |
|---|---|
| 3 | Ink images are completely dried within 10 minutes after printing. |
| 2 | Ink images are completely dried 10 to 30 minutes after printing. |
| 1 | Ink images are incompletely dried even 30 minutes after printing. |

[Water resistance of ink images]

The printed ink image portion of the recording sheet was immersed in water for 10 seconds and then dried in the ambient atmosphere.

The blotting of the ink around the ink images was evaluated in the following four classes.

| Class | Water resistance |
|---|---|
| 4 | No or very slight blotting of ink is found. Ink images are kept in substantially original conditions. |
| 3 | Slight blotting of ink is found. Usable in practice. |
| 2 | Ink-blotting is found. Practical use may be possible. |
| 1 | Ink-blotting is significant. Practical use is difficult. |

The test results are shown in Table 3.

TABLE 3

| | Ink-blotting resistance | Gloss of images (%) | Non-tarkiness | Ink-drying property | Water-resistance of ink images |
|---|---|---|---|---|---|
| Example | | | | | |
| III-1 | 3 | 92 | 3 | 3 | 3 |
| III-2 | 3 | 90 | 3 | 3 | 3 |
| III-3 | 3 | 82 | 3 | 3 | 3 |
| III-4 | 3 | 85 | 3 | 3 | 4 |
| III-5 | 3 | 81 | 3 | 3 | 3 |
| III-6 | 2 | 80 | 2 | 2 | 3 |
| III-7 | 2 | 90 | 3 | 3 | 2 |
| III-8 | 3 | 80 | 2 | 2 | 3 |
| III-9 | 3 | 83 | 3 | 3 | 3 |
| III-10 | 3 | 69 | 3 | 3 | 3 |
| III-11 | 3 | 92 | 3 | 3 | 3 |
| Comparative Example III-1 | 1 | 70 | 3 | 3 | 3 |

As Table 3 clearly shows, the test results of the ink jet recording sheets of Examples III-1 to III-11 wherein (A) the HPMC, (B) the N-vinyl pyrrolidone hompolyers or the copolymers of N-vinyll pyrrolidone with other polymerizable monomer, and (C) the cationic resins were contained in the ink receiving layer, were all satisfactory for practice.

Especially, in Example III-1 wherein a vinyl porrolidone-vinyl acetate copolymer was used, the ink images printed on the resultant ink receiving layer exhibited a higher gloss than that of Example III-4 wherein an alkylated PVP was employed. Also, in Example III-2 wherein the polyvinyl pyrrolidone having a weight average molecular weight of 60,000 which is less than 500,000, all of the test results are satisfactory for practical use.

In comparison with Example III-9 wherein a support sheet composed of a non-resin-coated sheet, namely a synthetic paper sheet, the Example III-1, wherein a resin-coated paper sheet was used as a support sheet and the ink receiving layer is the same as that of Example III-9, exhibited an excellent ink image gloss.

In Comparative Example III-1 in which a hydroxyethylcellulose was used in place of the HPMC, the resultant ink images exhibited a low blotting resistance.

In Example III-10 in which the vinyl pyrrolidonevinyl acetate copolymer is used in an amount less than 5 parts, the resultant ink images exhibited an unsatisfactory gloss of ink images.

In the present invention, the ink jet recording materials having no ink-blotting no tackiness, a high water resistance of ink images, an excellent gloss of ink images, and an excellent image quality could be obtained.

Example IV-1

Preparation of a Support Sheet

An aqueous pulp slurry having a consistency of 0.5% by suspending a mixture of a softwood bleached kraft pulp (NBKP) having a CSF (Canadian Standard Freeness, JIS P 8121) of 250 ml determined in accordance with Japanese Industrial Standard (JIS) and a hardwood bleached kraft pulp (LBKP) beaten to a CSF of 280 ml in a mixing weight ratio of 2:8 in an aqueous medium. The aqueous pulp slurry was added with 2% of a cationic starch, 0.4% of an alkylketene dimer, 0.1% of an anionic polyacrylamide resin and 0.7% of a polyamidepolyamine-epichlorohydrin resin, and the resultant slurry was fully agitated to disperse the additives in the slurry. The pH value of the aqueous pulp slurry was adjusted to 7.5 by adding an aqueous sodium hydroxide solution to the slurry.

The resultant pulp slurry was subjected to a paper-forming procedure using a wire paper-forming machine, then passed through a dryer, a sizepress, and a machine calendar, to provide a paper sheet having a basis weight of 180 g/m$^2$, a bulk density of 1.0 g/cm$^3$ and a water content of 7.5%. In the above-mentioned sizepress procedure, a sizepress liquid contained a mixture of 2 parts of a carboxyl-modified polyvinyl alcohol with 1 part of sodium chloride, dissoloved in water, and had a solid content of 5%. The sizepress liquid was coated in an amount of 25 ml/m$^2$ on the two surfaces of the dried paper sheet.

Coating with Polyolefin Resin Coating Layers

The front and back surfaces of the resultant base paper sheet were subjected to a corona discharge treatment.

Separately, a polyolefin resin composition (IV-1) for back coating was prepared by mixing the components in the amounts as shown below with a Bunbury's mixer. Also, a polyolefin resin composition (IV-2) for front coating was prepared in the composition shown below.

Polyolefin resin composition (IV-1)

| Component | Amount (part) |
|---|---|
| High density Polyethylene (density: 0.945 g/cm$^3$, melt index: 20 g/10 minutes) | 65 |
| Low density polyethylene resin (density: 0.914 g/cm$^3$, melt index: 4 g/10 minutes) | 35 |

Polyolefin resin composition (IV-2)

| Component | Amount (part) |
|---|---|
| Long linear low density polyethylene resin (density: 0.926 g/cm$^3$, melt index: 20 g/10 minutes. | 35 |
| Low density polyethylene resin (density: 0.919 g/cm$^3$, melt index: 2 g/10 minutes) | 50 |
| Anatase titanium dioxide (trademark: A-220, made by ISHIHARA SANGYO K.K., surface-treated with aluminum) having an average particle size of 0.2 $\mu$m | 10 |
| Zinc stearate | 0.1 |
| Anti-oxidant (trademark: IRGANOX 1010, made by Ciba-Geigy) | 0.03 |
| Ultramarine (Trademarks: Bluish ultramarine No. 2,000, made by DAIICHI KASEIKOGYO K.K. | 0.09 |
| Fluorescent brightening agent (trademark: UVITEX OB, made by Ciba-Geigy) | 0.3 |

The polyolefin resin composition (IV-1) was coated in a coating amount of 30 g/m$^2$ on the corona discharge-treated wire side surface (back surface) of the base paper sheet by using a melt-extruder with a T-die at a melt temperature of 280° C.

Also, the corona discharge-treated wire side surface of the base paper sheet was coated by the polyolefin resin composition (IV-2) in the same manner as that for the polyolefin resin composition (IV-2) to form a front polyolefin resin coating layer in an amount of 30 g/m$^2$, except that the surface of the resultant melt layer of the polyolefin resin composition (IV-2) was brought into contact with a chromium-plated, mirror-finished peripheral surface of a cooling roll to cool and solidify the melt layer.

The front polyolefin resin coating layer surface had a center line mean roughness Ra of 0.4 $\mu$m, determined in accordance with JIS B 0601.

Coating with a Back Layer

The back polyolefin resin coating layer surface was surface-activated by a corona discharge treatment, and then the corona discharge-treated surface was coated with a coating liquid having the composition as shown below, to form a coating layer in a dry weight of 10 g/m$^2$.

| Back coating liquid Component | Amount (part) |
|---|---|
| Polyvinyl alcohol (trademark: PVA 420, made by KURARAY K.K.) | 95 |
| Surfactant (Trademark: NONION MN811, | 0.1 |

-continued

| Back coating liquid Component | Amount (part) |
|---|---|
| made by NIPPON YUSHI K.K.) | |
| Synthetic amorphous silica (trademark: MIZUKASIL P-526, made by MIZUSAWA KAGAKUKOGYO K.K.) | 5 |

Coating with Ink Receiving Layer

An aqueous coating liquid for an ink receiving layer was prepared by dissolving and dispersing the composition shown below in water and was coated in a dry amount of 15 g/m$^2$ on the front polyolef in resin coating layer by using a bar coater and then was dried, to form an ink receiving layer.

An ink jet recording sheet was obtained.

| Ink receiving layer-forming coating liquid Component | Amount |
|---|---|
| Hydroxypropylmethylcellulose (trademark: METHOLOSE 60SH15, made by SHINETSU KAGAKUKOGYO K.K.) | 90 |
| Cationic dicyandiamide resin (trademark: E-117, made by NIKKA KAGAKU K.K.) | 10 |
| Amorphous silica made by a gel method and having an average particle size of 12.5 $\mu$m (trademark: MIZUKASIL P78F, made by MIZUSAWA KAGAKU K.K.) | 2 |

Example IV-2

An ink jet recording sheet was produced by the same procedures as in Example IV-1 with the following exceptions.

The coating liquid for the ink receiving layer had the following compositions.

Ink receiving layer-forming coating liquid

| Component | Amount |
|---|---|
| Hydroxypropylmethylcellulose (trademark: METHOLOSE 60SH50, made by SHINETSU KAGAKUKOGYO K.K. 2% aqueous solution viscosity: 50 cP) | 55 |
| Cationic dicyandiamide resin (trademark: E-117, made by NIKKA KAGAKU K.K.) | 10 |
| Polyvinylpyrrolidone (trademark: PVP K-15, weight average molecular weight: 10,000, made by ISP) | 35 |
| Amorphous silica made by a gel method and having an average particle size of 12.5 $\mu$m, (trademark: MIZUKASIL P78F, made by MIZUSAWA KAGAKU K.K.) | 2 |

Tests

[Printing]

The resultant ink jet recording sheet of the above-mentioned example was subjected to the following ink jet recording aptitude tests.

The ink jet recording sheet was printed with full colored ink images by using an ink jet plotter (trademark: BJC-420 (made by CANON K.K., using normal inks).

[Quality of solid-printed mixed colored ink images]

The uniformity in color density of solid-printed ink images in each color of red (magenta ink+yellow ink), green (yellow ink+cyan ink) and blue (cyan ink+magenta ink) colors was evaluated by the naked eye observation in the following three classes.

| Class | Uniformity |
|---|---|
| 3 | Substantially no unevenness in color density and ink absorption is found. Excellent print. |
| 2 | Certain unevenness in color density and ink absorption is found. Usable in practice. |
| 1 | Unevenness in color density and ink absorption is significant. Practical employment is difficult. |

[Blotting resistance]

The printed sheet was left to stand in a high temperature high humidity atmosphere (40° C., 90% RH) for 24 hours, and then blotting of the ink images was evaluated by the naked eye observation, into the following three classes.

| Class | Blotting resistance |
|---|---|
| 3 | No blotting of ink images is found. |
| 2 | Certain blotting of ink images is formed. Usable for practice. |
| 1 | Significant blotting of ink images is formed. The resultant ink images are unclear. |

[Gloss]

A non-printed portion of the ink jet recording sheet was subjected to a measurement of gloss at an angle of 75 degrees in accordance with JIS P 8142.

The semi-gloss grade recording sheet preferably has a gloss of 20 to 60%. When the gloss is less than 20%, the gloss is too low. When the gloss is more than 60%, this gloss does not fall within the semi-gloss range.

The test results are shown in Table 4.

TABLE 4

| | Example No. | |
|---|---|---|
| | Example IV-1 | Example IV-2 |
| Support sheet | Resin-coated paper sheet | Resin-coated paper sheet |
| Center line mean roughness (Ra) | 0.4 μm | 0.4 μm |
| Ink-absorbing polymer (A) | (HPMC METHOLOSE) | HPMC/PVP |
| Cationic resin (B) | E-117 | E-117 |
| Mixing ratio (A)/(B) | 90/10 | 90/10 |
| Inorganic pigment (C) | Silica P78F | Silica P78F |
| Average particle size | 12.5 μm | 12.5 μm |
| Mixing ratio (A + B)/(C) | 100:2 | 100:2 |
| Ink receiving layer amount | 15 g/m$^2$ | 15 g/m$^2$ |
| Test result | | |
| Image quality | 2 | 3 |
| Blotting resistance | 2 | 3 |
| Gloss | 30% | 35% |

In the embodiment of the present invention as illustrated in Example IV-1 and Example IV-2, the resultant ink jet recording sheets had the similar semi-gloss grade hand and appearance to those of conventional silver salt photographic printing sheets, excellent ink-absorption and a high resistance to ink-blotting and were useful for full color ink image-recording.

What is claimed is:

1. An ink jet recording material comprising a support and an ink receiving layer formed on a surface of the support and comprising hydroxypropylmethylcellulose (A) having a viscosity of 200 cP or less, determined in a 2% aqueous solution thereof at a temperature of 20° C., an N-vinyl pyrrolidone resin (B) comprising at least one member selected from the group consisting of homopolymers of N-vinyl pyrrolidone and copolymers of N-vinyl pyrrolidone with at least one other polymerizable monomer, and a cationic resin (C) in a mixing ratio (A):(B):(C) in weight of the hydroxypropylmethylcellulose (A) to the N-vinyl pyrrolidone resin (B) and the cationic resin (C), of 100:5 to 100:1 to 20.

2. The ink jet recording material as claimed in claim 1, wherein the viscosity of the hydroxypropylmethylcellulose is in the range of from 20 to 200 cP, determined in a 2% aqueous solution thereof at a temperature of 20° C.

3. The ink jet recording material as claimed in claim 2, wherein the hydroxypropylmethylcellulose has a degree of methoxy group-substitution, which is defined as an average number of hydroxyl groups substituted by methoxy groups per cyclic glucose unit of cellulose, of 1.5 or more.

4. The ink jet recording material as claimed in claim 1, wherein the N-vinyl pyrrolidone resin (B) is present in an amount of 5 to 150 parts by weight per 100 parts by weight of the hydroxypropylmethyl-cellulose.

5. The ink jet recording material as claimed in claim 1, wherein the support comprises a member selected from laminated paper sheets in which a base paper sheet is coated with a thermoplastic resin composition, and plastic films.

6. The ink jet recording material as claimed in claim 1, wherein the homopolymers of N-vinyl pyrrolidone and copolymers of N-vinyl pyrrolidone with at least one other polymerizable monomer have a weight average molecular weight of 5000 to 500,000.

7. The ink jet recording material as claimed in claim 1, wherein the support comprises a polyolefin resin-laminated paper sheet having a center line mean roughness Ra of 0.5 μm or less; and the ink receiving layer further comprises pigment particles having an average particle size of 1 to 30 μm, the pigment particles having the average particle size of 1 to 30 μm being present in a content of 1 to 10 parts by weight per 100 parts by weight of the total weight of the ink receiving layer;

the ink receiving layer being present in a dry weight of 3 to 20 g/m$^2$, and the ink jet recording material having an ink jet recording surface exhibiting a mirror surface gloss at an angle of 75 degrees of 20 to 60%, determined in accordance with JIS P 8142.

8. The ink jet recording material as claimed in claim 7, wherein the pigment particles having the average particle size of 1 to 30 μm are selected from inorganic pigment particles having an average particle size of 3 to 15 μm.

9. An ink jet recording material comprising a support and an ink receiving layer formed on a surface of the support and comprising hydrooxypropylmethylcellulose (A); a N-vinylpyrrolidone resin (B) comprising at least one member selected from the group consisting of homopolymers of N-vinyl pyrrolidone and copolymers of N-vinyl pyrrolidone with at least one other polymerizable monomer; and a cationic resin (C), the hydroxypropylmethylcellulose (A); the N-vinylpyrrolidone resin (B) and the cationic resin (C) are mixed in a mixing ratio (A)/(B)/(C) of 100:5 to 100:1 to 20.

10. An ink jet recording method for the ink jet recording material as claimed in claims 2, 4, 8, or 9, comprising jetting imagewise ink droplets containing, as a coloring material, a coloring pigment toward the ink receiving layer of the ink jet recording material, to form ink images on the ink receiving layer.

* * * * *